US008137252B2

(12) United States Patent
Yokota et al.

(10) Patent No.: US 8,137,252 B2
(45) Date of Patent: Mar. 20, 2012

(54) PACKAGING BAG SUPPLY DEVICE AND BAGGING DEVICE HAVING THE SAME

(75) Inventors: Yuji Yokota, Ritto (JP); Seisaku Iwasa, Ritto (JP); Yuichiro Minakuchi, Ritto (JP)

(73) Assignee: Ishida Co., Ltd., Kyoto (JP)

( * ) Notice: Subject to any disclaimer, the term of this patent is extended or adjusted under 35 U.S.C. 154(b) by 2366 days.

(21) Appl. No.: 10/839,313

(22) Filed: May 6, 2004

(65) Prior Publication Data

US 2004/0226260 A1 Nov. 18, 2004

(30) Foreign Application Priority Data

May 12, 2003 (JP) ..... 2003-132980
May 12, 2003 (JP) ..... 2003-132981
May 12, 2003 (JP) ..... 2003-132982

(51) Int. Cl.
*B31B 1/64* (2006.01)

(52) U.S. Cl. ..... 493/196; 493/3; 53/570; 53/389.1

(58) Field of Classification Search ..... 493/196, 493/201, 480, 3; 53/570, 571, 389.1, 389.5, 53/389.2, 389.4, 572, 384.1, 385.1, 386.1
See application file for complete search history.

(56) References Cited

U.S. PATENT DOCUMENTS 4,516,762 A * 5/1985 Moltrasio et al. ..... 271/11
4,545,184 A * 10/1985 Akiyama ..... 53/571
4,643,412 A * 2/1987 Heina et al. ..... 271/94
4,753,060 A * 6/1988 Furukawa ..... 53/459
5,024,042 A * 6/1991 Meyer ..... 53/168
5,457,944 A * 10/1995 Lipes ..... 53/572
5,799,465 A * 9/1998 Townsend ..... 53/258
5,813,196 A * 9/1998 Page et al. ..... 53/448
6,006,495 A * 12/1999 Varichon et al. ..... 53/384.1
6,318,052 B1 * 11/2001 Kuhar ..... 53/570

FOREIGN PATENT DOCUMENTS

JP 5-34107 U 5/1993
JP 7-257518 A 10/1995
JP 2004-083058 A 3/2004
NL 7501997 A 8/1975

* cited by examiner

*Primary Examiner* — Sameh H. Tawfik
(74) *Attorney, Agent, or Firm* — Global IP Counselors, LLP

(57) ABSTRACT

A bag supply device receives large bags are retained in a stacked state on its mounting portions that are provided on chains. In addition, this bag supply device includes a horizontal support mechanism that supports the rear portion of the stacked large bags so that they can be raised and lowered in order to retain an uppermost surface of an uppermost large bag in a horizontal posture at a discharge position. The chains and the mounting portions are disposed such that the rear portion of the large bags hangs down. The horizontal support mechanism includes a roller that moves along the transport direction, and the uppermost large bag will be retained in a horizontal posture by moving the roller to support the rear portion of the large bags from below.

28 Claims, 17 Drawing Sheets

PACKAGING BAG SUPPLY DEVICE AND BAGGING DEVICE HAVING THE SAME

BACKGROUND OF THE INVENTION

1. Field of the Invention

The present invention is in the article packaging field, and relates to a packaging bag supply device that supplies packaging bag to a discharge position, and to a bagging device that includes the packaging bag supply device and which discharges one packaging bag at a time in the discharge position and bags articles at a bagging position.

2. Background Information

For example, a product that aligns a plurality of small bags filled with snack foods and packs them into a large bag is being sold. The large bag is made of a synthetic resin, has ample softness and flexibility, and is provided with a hole through which a hand can pass so that large bag can be easily carried after purchase. Generally, the process of packing articles into this type of packaging bag (large bag) includes supplying a plurality of packaging bags to a discharge position after mounting the plurality of packaging bags onto a mounting portion in a stacked state at a mounting position, discharging one packaging bag at a time from the mounting portion at the discharge position, transporting the discharged packaging bags to a bagging station which is at a bagging position, opening the transported packaging bags, and inserting and bagging articles into the opened packaging bags.

An example of a packaging bag supply device that supplies packaging bags from a mounting position to a discharge position after the packing bags are mounted on a mounting portion is disclosed in Japanese Utility Model Publication H05-34107 (page 5, FIG. 1). This device includes a transportation conveyor that transports the packaging bags in the horizontal direction. The rear end of the transportation conveyor is the mounting position, and a stocker (a mounting portion) that retains packaging bags in a vertical posture and in a stacked state is removably linked to the rear end portion of the transportation conveyor. The packaging bags that are transported from the stocker by the transportation conveyor are dispatched forward by a quick-dispatch conveyor that is disposed above the approximate central portion of the transportation conveyor. The packaging bags that have been sequentially placed in the horizontal posture are then supplied one by one to the discharge position provided in a front end portion of the transportation conveyor by a ratchet wheel that is rotatively driven. After that, the packaging bags are taken up by a suction type bag discharge mechanism that is disposed above the discharge position, and are transported further downstream. In addition, the replenishment of the packaging bags is performed by exchanging the stocker.

As disclosed in Japanese Utility Model Publication H05-34107 noted above, in a situation where a container type mounting portion in which a plurality of packaging bags are horizontally stacked in the mounting position is provided in a device configured to extend in the horizontal direction from the mounting position to the discharge position, when for example the packaging bags have a fold arranged in the bottom portion of each (here, the rear portion), i.e., are gusset type packaging bags, it is common for the total thickness of the rear portion to be comparatively larger than the front portion, and for the uppermost packaging bag to be no longer retained in a horizontal posture. In this situation, if a suction type bag discharge mechanism is used to discharge the packaging bags from the mounting portion, the suction portions of the bag discharge mechanism will no longer properly contact with the packaging bags, the suction gripping of the packaging bags will become unstable, and discharge errors will easily occur. As a result, problems will be created, such as the discharge of the packaging bags no longer being smoothly performed and a decrease in production efficiency.

In view of the above, it will be apparent to those skilled in the art from this disclosure that there exists a need for an improved packaging bag supply device that overcomes the above-discussed problems. This invention addresses this need in the art as well as other needs, which will become apparent to those skilled in the art from this disclosure.

SUMMARY OF THE INVENTION

An object of the present invention is to provide a packaging bag supply device that is capable of operating with improved production efficiency, and to provide a bagging device that includes such packaging bag supply device.

A packaging bag supply device according to the first aspect of the present invention is a device that supplies packaging bags to a packaging bag discharge position one by one, and includes transportation means horizontal support means, and control means. The transportation means transports a plurality of stacked packaging bags from a mounting position to the discharge position. The horizontal support means supports the plurality of stacked packaging bags such that the uppermost surface of the uppermost packaging bag is retained in a horizontal posture at the discharge position. The control means controls the horizontal support means such that the uppermost surface of the uppermost packaging bag is supported in the horizontal posture.

According to this aspect of the present invention, the uppermost packaging bag is retained in a horizontal posture at the discharge position by the horizontal support means. Thus, when for example a suction type bag discharge mechanism is used, the suction portions of the bag discharge mechanism will properly come into contact with the packaging bag, and the suction gripping of the packaging bags will be performed securely. Because of this, discharge errors will be reduced, the discharge of the packaging bags will be smoothly performed, and production efficiency will be improved.

A packaging bag supply device according to the second aspect of the present invention is the packaging bag supply device of the first aspect of the present invention, in which the horizontal support means supports the rear portion of the packaging bags at the discharge position.

According to this invention, in situations in which the rear portion of the packaging bags hangs over the discharge position in particular, the control means optimizes the support state of the packaging bag by the horizontal support means. In other words, the uppermost surface of the uppermost packaging bag will be easily retained in a horizontal posture.

A packaging bag supply device according to the third aspect of the present invention is the packaging bag supply device of the first aspect of the present invention, in which the horizontal support means includes a support roller.

According to this invention, a large increase in costs will not occur because the horizontal means uses a simple structural member, which is the support roller.

A packaging bag supply device according to the fourth aspect of the present invention is the packaging bag supply device of the first aspect of the present invention, in which the transportation means includes a first mounting portion to which the packaging bags are mounted at the mounting position.

A packaging bag supply device according to the fifth aspect of the present invention is the packaging bag supply device of the fourth aspect of the present invention, in which the first mounting portion does not interfere with the horizontal support means when the control means controls the horizontal support means to retain the uppermost surface of the uppermost packaging bag in the horizontal posture.

According to the present invention, a structure is achieved in which interference will not occur between the first mounting portion and the horizontal support means, and the uppermost surface of the uppermost packaging bag will be retained in a horizontal posture.

A packaging bag supply device according to the sixth aspect of the present invention is the packaging bag supply device of the fourth aspect of the present invention, in which the first mounting portion can mount packaging bags in a substantially vertical posture at the mounting position. In addition, the transportation means includes an endless member such that the packaging bags are transported from the mounting position to the discharge position by the endless member.

Because the packaging bag supply device disclosed in Japanese Utility Model H05-34107 noted above shows a structure that extends in the horizontal direction from the mounting position to the discharge position, the device is enlarged and lengthened, and cannot be made compact.

In addition, when the packaging bags are to be replenished, each time the stocker becomes empty, for example, discharge of the packaging bags is stopped, and a stocker in which a plurality of packaging bags are retained in stacked state is exchanged with the empty stocker. Thus, a reduction in production efficiency will occur with a packaging bag supply device such as one disclosed in Japanese Utility Model Publication H05-34107. Note that preparing a plurality of stockers in advance in order to prevent a decrease in efficiency has been considered. In such cases, however, mounting locations of these stockers must be maintained in this device, and thus the length or width of the device will increase, and there will be a need for stockers of different sizes for each type of packaging bag.

In contrast, according to the sixth aspect of the present invention, the mounting position can be arranged below the discharge position because the packaging bags can be mounted on the mounting portion in a substantially vertical posture. Thus, a transportation means can be used that is vertical in the interval from the mounting position to the discharge position, and the length and width of the transportation means can be shortened compared to a conventional horizontal transportation means that extends in the horizontal direction. This allows the packaging bag supply device to be made more compact and smaller.

A packaging bag supply device according to the seventh aspect of the present invention is the packaging bag supply device of the fourth aspect of the present invention, in which the first mounting portion includes bag retaining means that retains the packaging bags. The bag retaining means retains the front portion of the packaging bags in an inclined posture relative to a vertical direction when in the mounting position.

According to this invention, the task of, for example, manually mounting the packaging bags to the first mounting portion can be simplified because the bag retaining means retains the front portion of the packaging bags on the first mounting portion in an inclined posture.

With, for example, so-called gusset type packaging bags, each of which is provided with a fold in the bottom portion (here, rear portion) thereof and has multiple layers, when a plurality of the packaging bags is stacked together, the total thickness of the rear portion thereof (the overall thickness of the rear portion of the plurality of stacked packaging bags) is comparatively larger than that of the front portion. As a result, when the bag retaining means retains the packaging bags in a vertical posture on the mounting position, the rear portion having an expanded thickness will move away from the transportation means and the first mounting portion, and thus the front portion of the packaging bags may no longer be able to be retained by the bag retaining means due to the structure of the bag retaining means. For example, when the bag retaining means is pin shaped members that pass through holes provided in the front portion of the packaging bags, the mounted packaging bags can fall off from the bag retaining means due to the aforementioned movement away from the transportation means and the first mounting portion.

In contrast, when the bag retaining means of the present invention retains the front portion of the packaging bags in an inclined posture, force will be applied to the packaging bags toward the transportation means and the first mounting portion, and thus problems such as no longer being able to retain the front portion of the packaging bags by the bag retaining means will be effectively avoided and production efficiency will improve.

A packaging bag supply device according to the eighth aspect of the present invention is the packaging bag supply device of the seventh aspect of the present invention, in which the bag retaining means includes a pair of pins that are adapted to be inserted into holes provided in the packaging bags. The pair of pins is provided such that a space between the pair of pins is adjustable.

In this invention, the packaging bags are mounted to the transportation means by inserting the pins of the mounting portion into the holes of the packaging bags, and the task of mounting the packaging bags is simplified. Furthermore, even if the space between the pair of holes provided in the front portion of the packaging bags changes in accordance with the size of the packaging bags to be mounted, since the packaging bag supply device of this aspect of the present invention can use a variety of different sizes of packaging bags because the space between the pair of pins can be changed in accordance with the space between the holes on the packaging bags.

A packaging bag supply device according to the ninth aspect of the present invention is the packaging bag supply device of the eighth aspect of the present invention, in which the first mounting portion further includes a plurality of support members that support the packaging bags. One of the plurality of support members that is frontmost in a transport direction has the pair of pins provided therewith. In addition, one of the plurality of support members that is rearmost in the transport direction has a control member that controls a position of the packaging bags in a direction perpendicular to the transport direction.

According to the present aspect of the invention, due to the location of the pins provided in the forward-most support member and the control members provided on the rearmost support member, the packaging bags mounted on the first mounting portion can be suitably positioned on the transportation means, the posture of the packaging bags during transport will be stable, and the discharge of the packaging bags at the discharge position will be smoothly performed.

A packaging bag supply device according to the tenth aspect of the present invention is the packaging bag supply device of the fourth aspect of the present invention, in which the transportation means further includes a second mounting portion spaced apart from the first mounting portion by a predetermine distance such that when one of the first and second mounting portions is at the discharge position, the other of the first and second mounting portions is positioned at the mounting position.

According to this invention, while for example the first mounting portion is at the discharge position and packaging bags are being discharged, packaging bags can be mounted on the second mounting portion that is positioned at the mounting position. Thus, even if the discharge of the packaging bags is stopped as is done conventionally, the packaging bags can be replenished and production efficiency can be improved.

A packaging bag supply device according to the eleventh aspect of the present invention is the packaging bag supply device of the first aspect of the present invention, further including horizontal detection means that is operatively coupled to the control means and detects whether or not the uppermost surface of the uppermost packaging bag is horizontal at the discharge position.

According to this aspect of the present invention, measures can be taken so that the uppermost surface of the uppermost packaging bag can be placed in the horizontal posture based upon the detection results of the horizontal detection means. Thus, when for example a suction type bag discharge mechanism is used, the suction portions of the bag discharge mechanism will properly come into contact with the packaging bag, the suction gripping of the packaging bags will be stabilized, and discharge errors will be reduced. As a result, the discharge of the packaging bags will be smoothly performed and production efficiency will improve.

A packaging bag supply device according to the twelfth aspect of the present invention is the packaging bag supply device of the eleventh aspect of the present invention, in which the horizontal detection means includes a first bag position sensor and a second bag position sensor. The first bag position sensor detects the vertical position of the front portion of the uppermost packaging bag in a transportation direction of the transportation means. The second bag position sensor detects a vertical position of the rear portion of the uppermost packaging bag in the transportation direction.

According to this invention, the vertical positions of the front and rear portions of the packaging bags will be detected by the first and second position sensors that are disposed on front and rear portions with respect to the transport direction. Thus, whether or not the packaging bags are in a horizontal posture can be correctly detected.

A packaging bag supply device according to the thirteenth aspect of the present invention is the packaging bag supply device of the fourth aspect of the present invention, in which the first mounting portion is sized to be shorter than the packaging bags in a transport direction.

A packaging bag supply device according to the fourteenth aspect of the present invention is the packaging bag supply device of the tenth aspect of the present invention, further including first and second bag presence sensors. The first bag presence sensor is disposed at the discharge position and determines whether packaging bags are present on one of the first and second mounting portions that is at the discharge portion. The second bag presence sensor is disposed at the mounting position and determines whether packaging bags are present on one of the first and second mounting portions that is at the mounting position. The control means is operatively coupled to the first and second bag presence sensors and controls the transportation means based on detection results of the first and second bag presence sensors.

A bagging device according to the fifteenth aspect of the present invention includes the packaging bag supply device of any of the first to fourteenth aspects of the present inventions, the packaging bag supply device discharging packaging bags one by one in the discharge position such that small bags are packaged in the large bag at a bagging position.

According to this invention, the same effects as those obtained from the packaging bag supply device according to any of the first to fourteenth aspects of the present invention will be obtained even in the bagging device.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

A production line for packaged goods according to an embodiment of the present invention will be described below.

Figure 1:
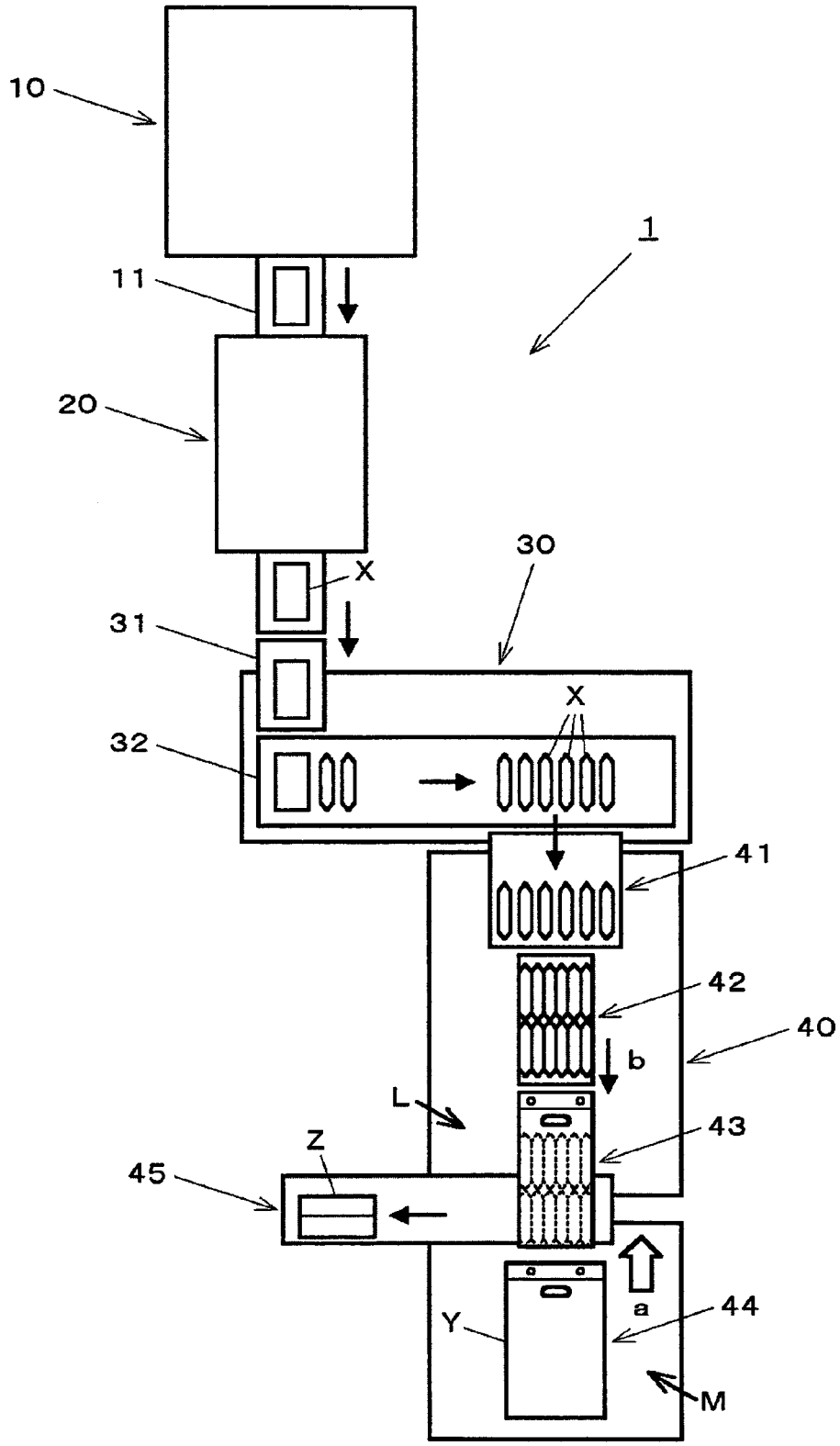
FIG. 1 is a schematic plan view of an article bagging production line in accordance with an embodiment of the present invention.

As shown in FIG. 1, a production line 1 produces bagged items Z that are each composed of a plurality of small bags X . . . X packed into a large bag Y. A total of twelve small bags X . . . X formed into two rows of six and filled with a snack food are packaged in each bagged item Z. The principle components of the production line 1 include a packaging machine 10, a seal checker 20, an alignment/transportation device 30, and a bagging device 40.

The packaging machine 10 is a well-known vertical pillow packaging machine, and fills the small bags X with snack foods that were weighed to a predetermined weight with a weighing device on the upstream side (not shown in the figures), and discharges the small bags X in a horizontal posture onto an intermediate conveyer 11. As the discharged small bags X are transported by the intermediate conveyer 11, their seals are inspected for errors as they pass through the seal checker 20. Next, the small bags X that have passed through the seal checker 20 are supplied one by one to the alignment/transportation device 30 via the introduction conveyer 31. The alignment/transportation device 30 places the supplied small bags X into a vertical posture with a retaining portion provided on a transport conveyer 32, while transporting groups of six small bags X up to the front of the bagging device 40. Since packaging machines, seal checkers, alignment/transportations devices 30 are well-known to the ordinarily skilled in the art, further description and illustration of the packaging machine 10, the seal checker 20, and the alignment/transportation device 30 will be omitted herein.

The bagging device 40 includes an introduction device 41, an alignment device 42, a bagging station 43, a bag supply device 44, and a discharge device 45. The small bags X . . . X transported to the front of the bagging device 40 are pushed out from the alignment/transportation device 30 to the introduction device 41 of the bagging device 40, and are then brought together in a row-wise direction with an alignment device 42 and aligned together with the next succeeding set of small bags X . . . X into two rows. Then, an empty large bag Y at a discharge position M is discharged from a bag supply device 44 and transported in the direction indicated by the arrow a to a bagging station 43 which is located in a bagging position L. Here, the opening of the large bag Y is open, and the small bags X . . . X aligned into two rows of six are inserted in the large bag Y in the direction indicated by the arrow b. After this, the opening of the large bag Y is horizontally sealed to form the final bagged item Z, and is carried by the discharge device 45 in a vertical posture in which the horizontally sealed opening is pointing upward.

Figure 2A:
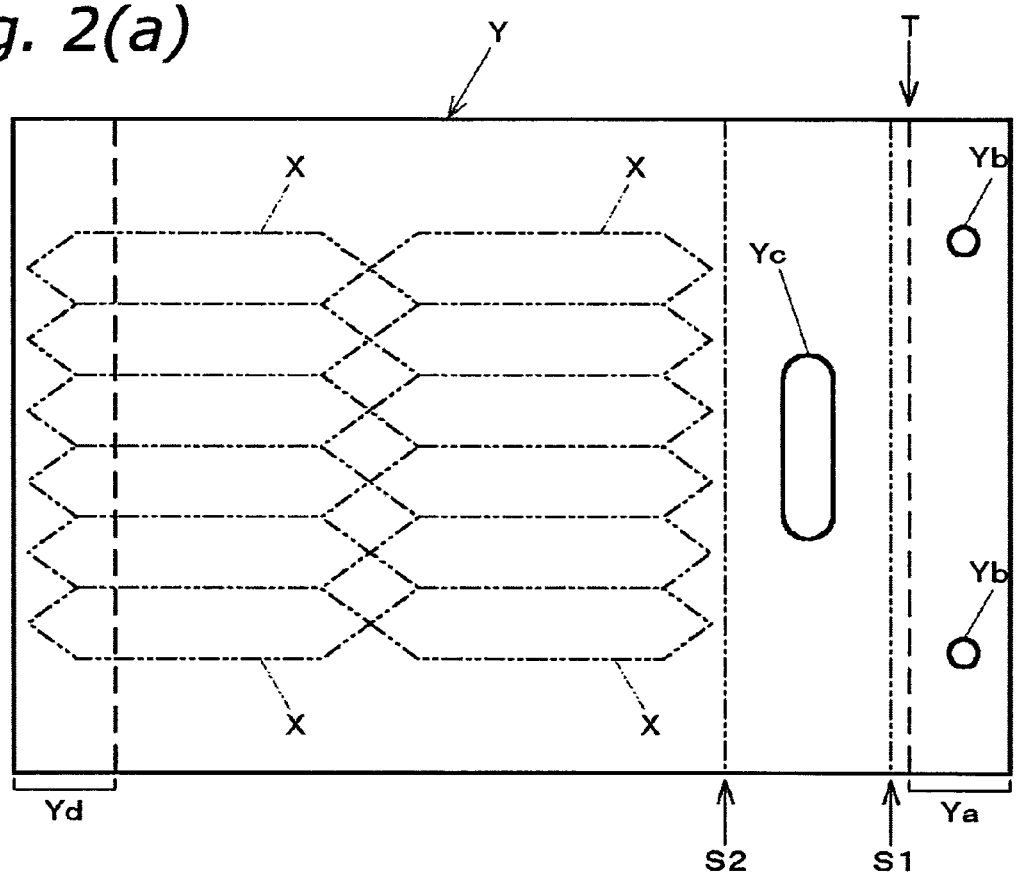
FIGS. 2 show the configuration of a large bag to be used on the production line in accordance with the embodiment of the present invention, with (a) being a plan view and (b) being a lateral view.
Figure 2B:
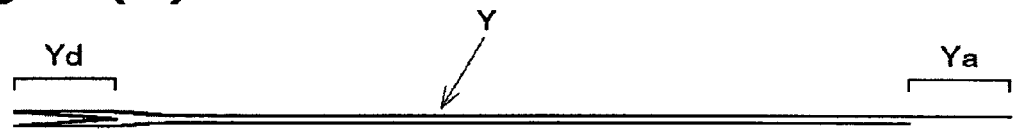

The large bag Y is made, for example, from a flexible synthetic resin, and as shown in FIG. 2, has an extension Ya that extends past an opening T and is formed on only one surface of the large bag Y. In addition, two holes Yb, Yb are arranged spaced apart by a predetermined distance in the extension Ya. Furthermore, an oval hole Yc that allows a hand to pass therethrough and carries the large bag Y is arranged near the opening T. The small bags X . . . X are packed into the large bag Y up to the oval hole Yc, i.e., in the portion on the left side as viewed in FIG. 2. In addition, the large bag Y is horizontally sealed at two locations S1, S2 when the bagged item Z is formed, with the oval hole Yc being interposed between the seal locations S1 and S2. The horizontal seal location S2 on the left side is a seal in which the upper surface and the lower surface of the large bag Y are fused together to seal the packed small bags X . . . X therein. The horizontal seal location S1 on the right side is a seal in which the upper surface and the lower surface of the large bag Y one likewise fused together, and the extension Ya is cut off from the body of the large bag Y simultaneously with the fusing. The large bag Y is a so-called gusset type packaging bag. A fold Yd that serves to create a thickness, which allows the bagged item Z to stand on its own when the bagged item Z is produced, is formed in the bottom portion of the large bag Y, and the thickness of the portion of the fold Yd is enlarged. Note that the large bag Y is transported by the bag supply device 44 with the surface of the large bag Y on which the extension Ya is located being on top, such that the side of the large bag Y on which the extension Ya is located is pointing forward. After this, a new large bag Y is discharged from the bag supply device 44, and is supplied to the bagging station 43.

Configuration of the Bagging Station and the Bag Supply Device

Next, the bagging station 43 and the bag supply device 44, which are the important components amongst the principle components of the bagging device 40, will be described.

Figure 3:
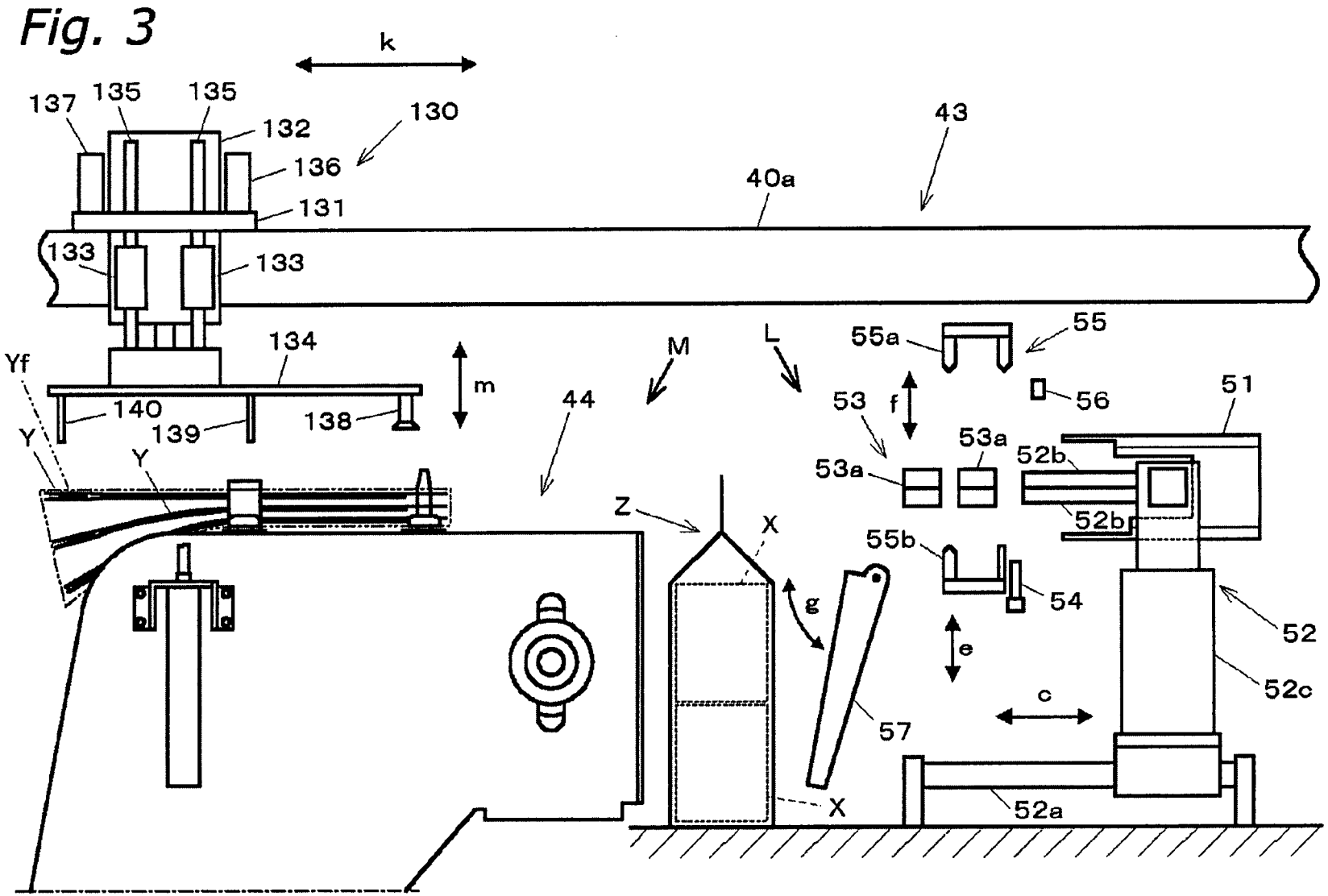
FIG. 3 is a lateral schematic view of a bagging station in accordance with the first embodiment of the present invention.
Figure 4:
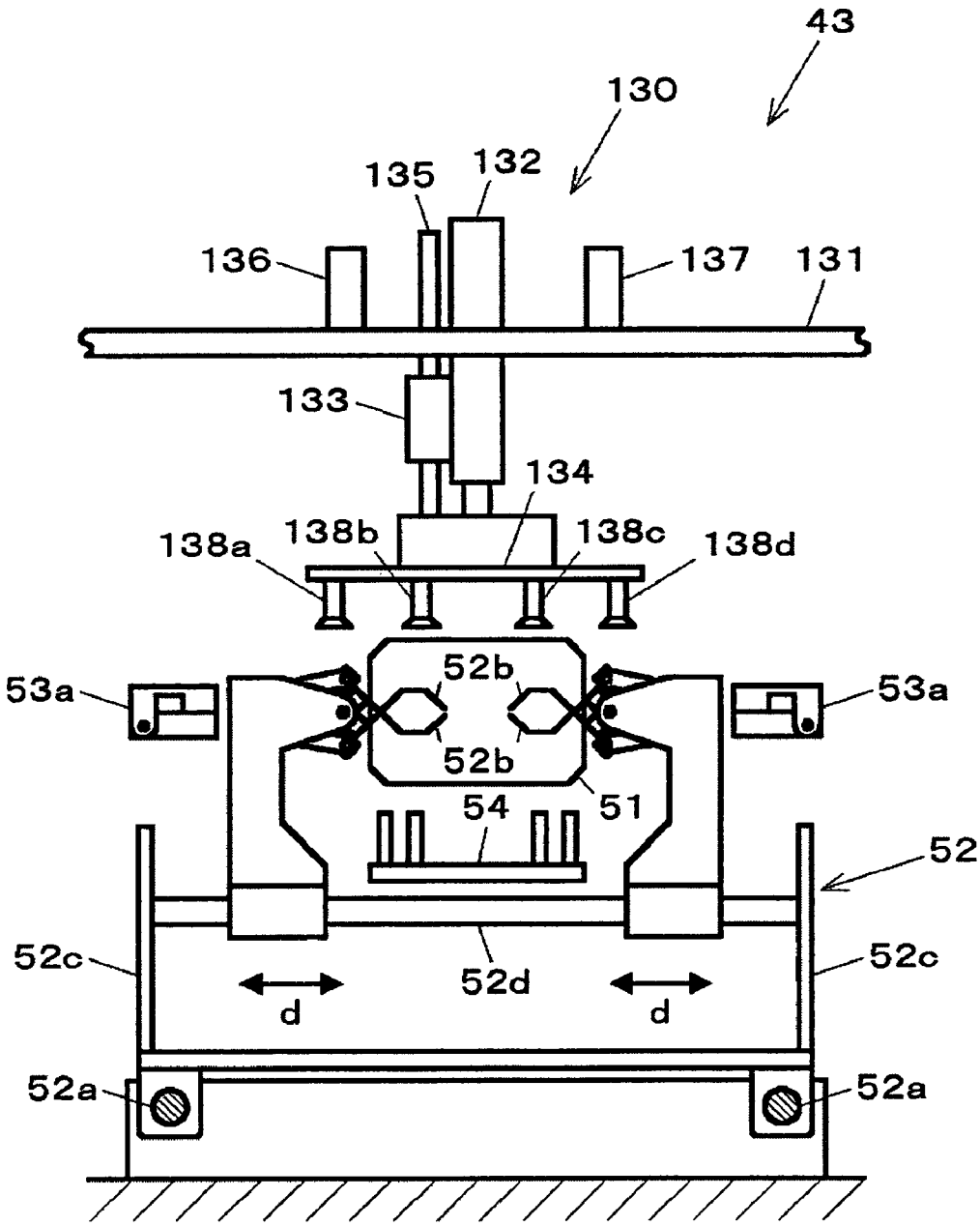
FIG. 4 is a rear schematic view of the bagging station in accordance with the embodiment of the present invention.

First, as shown in FIGS. 3 and 4, the bagging station 43 which is located at the bagging position L opens the openings T of large bags Y that are discharged one by one and supplied thereto from the bag supply device 44 at a discharge position M. Then, after the bagging station 43 packs aligned small bags X . . . X into large bags Y via the opened openings T, bagged items Z are obtained by horizontal sealing near the openings T. The bagging station 43 includes, among other things, a small bag insertion guide 51, a bag opening device 52, a bag edge gripping mechanism 53, a lower side suction mechanism 54, a horizontal seal mechanism 55, a bag extension clamping member 56, and a bag discharge flap 57.

The small bag insertion guide 51 is tubular in shape, and is disposed such that the central axis thereof extends horizontally. Small bags X . . . X pushed out by a pusher not shown in the figures pass through the interior of the small bag insertion guide 51 and are inserted into a large bag Y.

The bag opening device 52 is movable forward and backward along rods 52*a*, 52*a* that are positioned on the floor surface and extending in the direction indicated by the arrow c. The bag opening device 52 includes a total of four bag opening members 52*b* . . . 52*b* are vertically and horizontally positioned and open the opening T of each large bag Y. These bag opening members 52*b* . . . 52*b* that are movable in the directions indicated by the arrows d along a pair of rods 52*d*, 52*d* (only one of which is shown in FIG. 4) that are installed between a pair of frame members 52*c*, 52*c*.

The bag edge gripping mechanism 53 includes a total of four chucks 53*a* . . . 53*a* that are positioned front to rear and left to right. The chucks 53*a* . . . 53*a* grip the relative front portions of the large bags Y (front portions), i.e., the left to right edge portion near the opening T of each large bag Y.

The lower side suction mechanism 54 moves up and down in the directions indicated by the arrow e, and grips the bottom surface of each large bag Y by suction to open the opening T when the lower side suction mechanism 54 is moved downward.

The horizontal seal mechanism 55 includes a pair of vertically positioned sealing jaws 55*a*, 55*b* that move vertically in the directions indicated by the arrow f and are connected in mutually opposing positions. The vertical pair of seal jaws 55*a*, 55*b* horizontally seal the predetermined two locations S1, S2 of each large bag Y.

The bag extension clamping member 56 moves vertically in the directions indicated by the arrow f, and clamps the extension Ya of each large bag Y from above. In addition, during horizontal sealing by the horizontal seal mechanism 55, the bag extension clamping member 56 plays a role in ensuring that the extension Ya is cut.

The bag discharge flap 57 pivots in the directions indicated by the arrow g. In other words, when pivoted upward, the bag discharge flap 57 supports each large bag Y from the bottom. When pivoted downward, the bag discharge flap 57 transfers a bagged item Z made up of small bags X . . . X packed into a large bag Y to the discharge device 45 on the downstream side with the bagged item Z positioned with its opening T on top.

Note that the bag opening device 52, the bag edge gripping mechanism 53, the lower side suction mechanism 54, the horizontal seal mechanism 55, the bag extension pushing member 56, and the bag discharge flap 57 are respectively driven by a drive source not shown in the figures.

Figure 5:
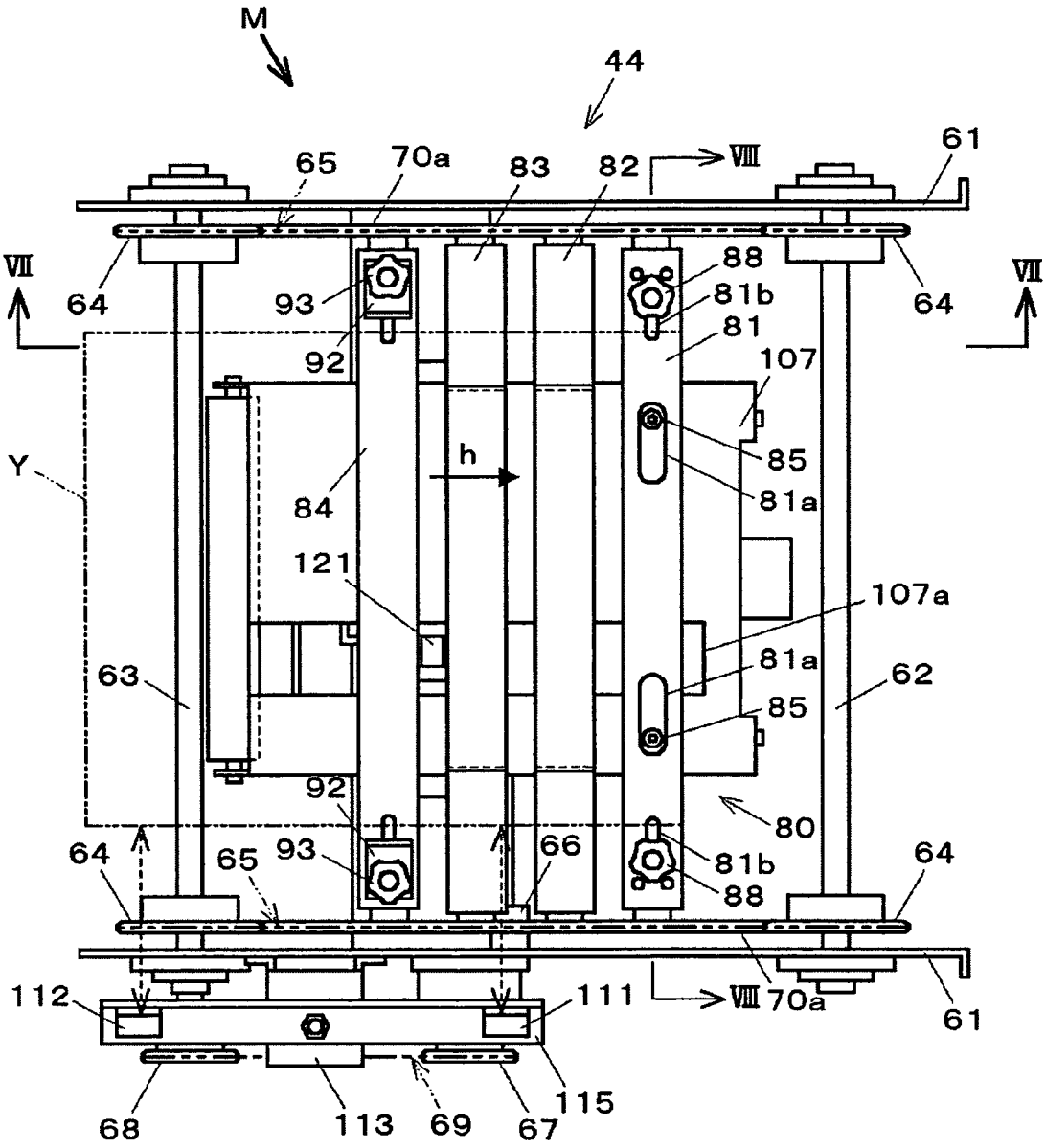
FIG. 5 is a schematic plan view of the a bag supply device in accordance with the embodiment of the present invention.
Figure 6:
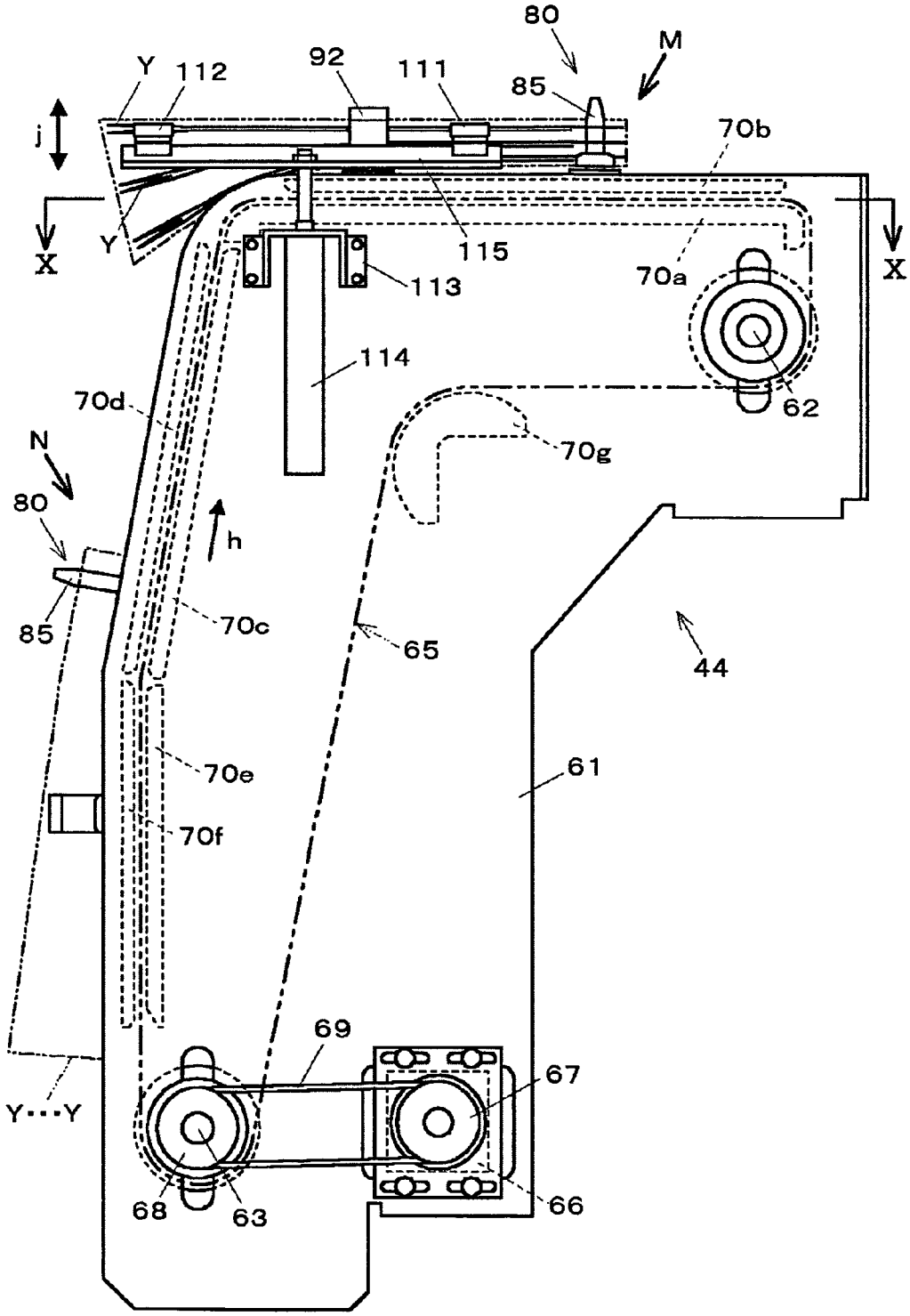
FIG. 6 is a schematic lateral view of the bag supply device in accordance with the embodiment of the present invention.
Figure 7:
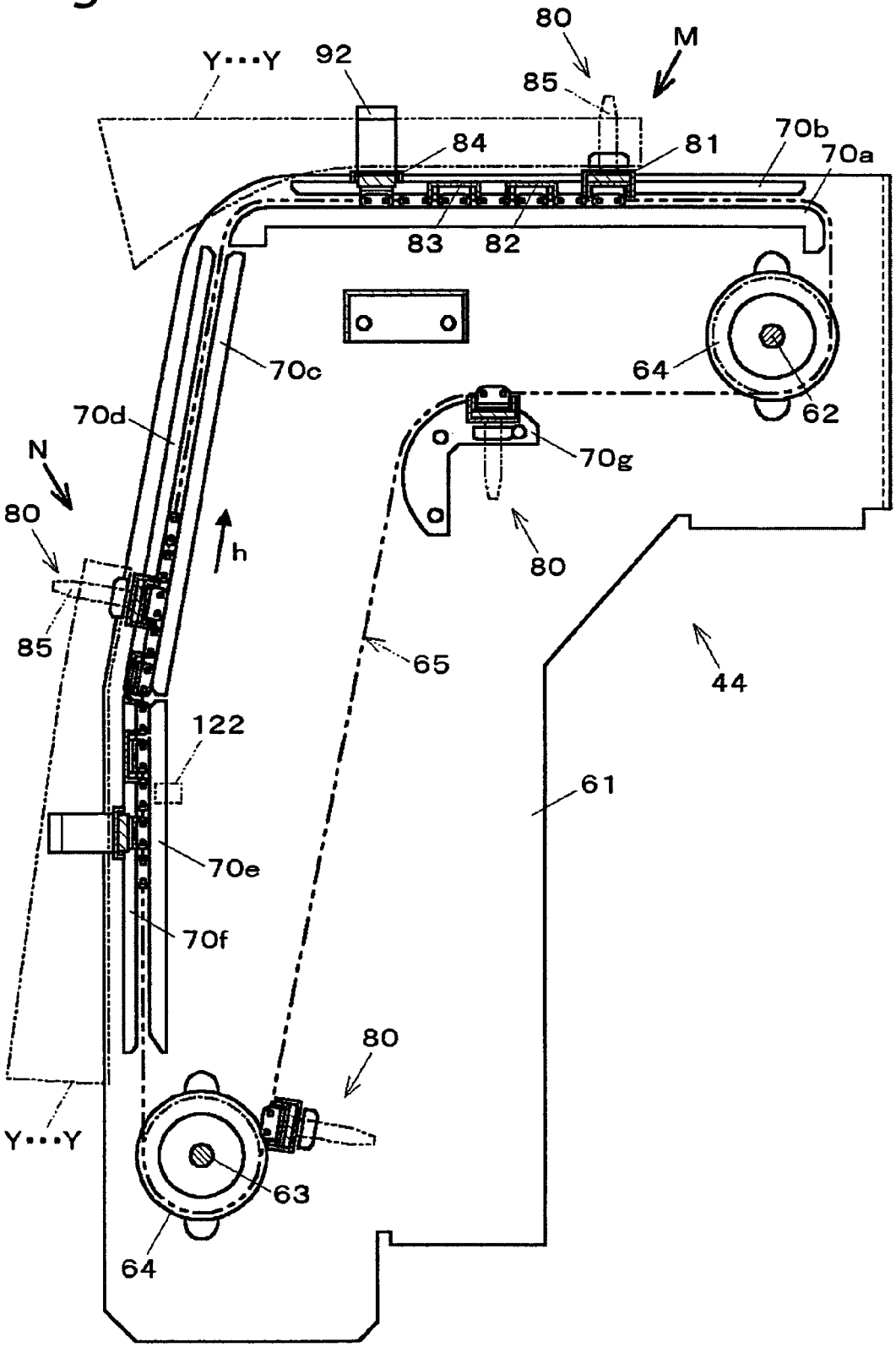
FIG. 7 is a view of the bag supply device in accordance with the embodiment of the present invention, viewed along a line VII-VII of FIG. 5.

As shown in FIGS. 5 to 7, the bag supply device 44 having a mounting position N and a discharge position M supplies a plurality of large bags Y . . . Y mounted in the mounting position N to the discharge position M in a stacked state. Shafts 62, 63 are rotatively supported between the front upper portion and a rear lower portion of a pair of side frames 61, 61 that generally extend in the vertical direction and whose side surfaces are formed into approximate L-shapes. Sprockets 64, 64 are respectively attached near both ends from left to right on the shafts 62, 63 on the inside of the frames 61, 61. Endless chains 65, 65 (an example of transportation means) are respectively wrapped between the sprockets 64, 64 from front to rear.

A motor 66 is attached to the lower side of one of the side frames 61. An endless chain 69 is wrapped between a sprocket 67 that is fixedly coupled to an output shaft of the motor 66, and a sprocket 68 that is attached to the shaft 63 that projects outward from one of the side frames 61. This allows the drive force of the motor 66 to be transmitted to the shaft 63 via the chain 69, and the left to right chains 65, 65 to be operated by rotating the shaft 63.

Guide members 70*a*-70*a* which have a predetermined shape and guide the chains 65 are fixedly attached to predetermined locations on each side frame 61. This allows the chains 65 indicated by thick dot-dash lines in the figures to stably circulate along a path that extends in approximately the vertical direction. In other words, the chains 65 that move in the transport direction, i.e., in the direction indicated by the arrow h, will move horizontally in the discharge position M, and then will move perpendicularly, horizontally, and diagonally downward. Then, the chains 65 move perpendicularly upward and through the mounting position N, and then diagonally upward until they reach the discharge position M. Note that in FIG. 5, only the guide members 70*a* are illustrated in order to avoid complicating the figures.

Four mounting portions 80 . . . 80 (examples of first mounting portions) are arranged in a predetermined spaced relationship between the chains 65, 65 and in the transport direction h. A plurality of large bags Y . . . Y is mounted in a stacked state on the mounting portions 80 . . . 80. The mounting portions 80 . . . 80 are spaced such that when a leading mounting portion 80 is at the discharge position M, the next successive mounting portion 80 is positioned at the mounting position N.

As shown in FIG. 5, each mounting portion 80 includes four first to fourth support members 81-84. The first to fourth support members 81-84 are long in a direction perpendicular to the transport direction, and are generally channel shaped (in the shape of U) in cross-section. In addition, the first to fourth support members 81-84 are linked to both chains 65, 65 via brackets in the transport direction h with a predetermined space therebetween, and support the large bags Y . . . Y from the bottom surface thereof.

Figure 8:
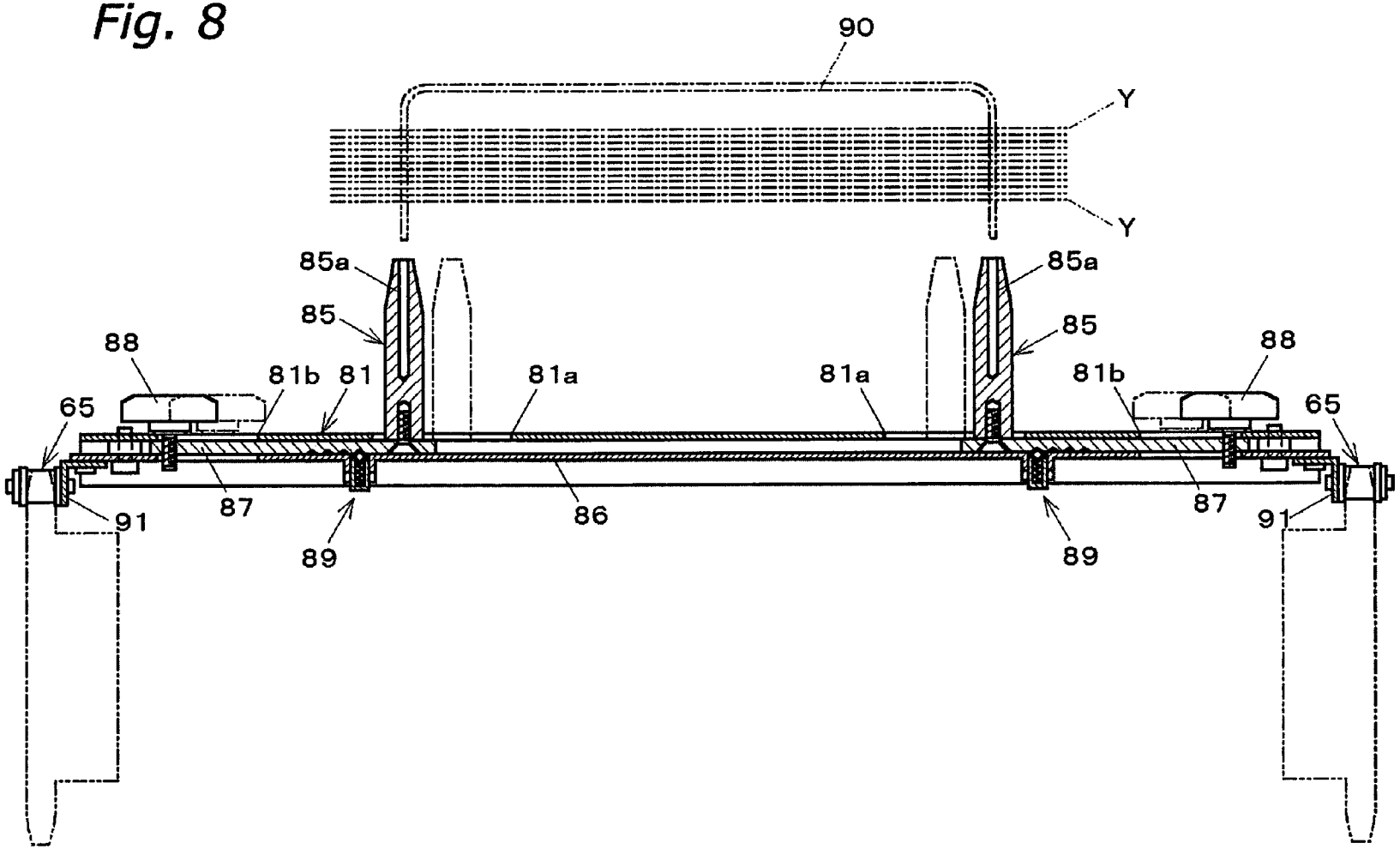
FIG. 8 is an enlarged cross-sectional view of the bag supply device in accordance with the embodiment of the present invention, viewed along a line VIII-VIII of FIG. 5.

As shown in FIG. 5 and 8, pins 85, 85 (an example of bag retaining means and second mounting portions) are erected on the forward-most first support member 81 in the transport direction h. The pins 85, 85 are inserted into the pair of left to right holes Yb, Yb provided in the front portion of the large bag Y. The space between the pins 85, 85 can be adjusted.

In other words, a pair of left to right flat slide members 87, 87 are slidably inserted in a space between the first support member 81 and an attachment member 86 that is attached to inside the first support member 81. The pins 85, 85 are respectively fixedly coupled to the inner end portions of the slide members 87, 87. Knob bolts 88, 88 that are operated when the slide members 87, 87 are to be slid are respectively installed on the outer end portions of the slide members 87, 87. In addition, oval holes 81*a*, 81*a* that allow movement of the pins 85, 85 in a direction perpendicular to the transport direction, and oval holes 81*b*, 81*b* that allow movement of the knob bolts 88, 88 in a direction perpendicular to the transport direction, are provided in the upper surface of the first support member 81.

Figure 9:
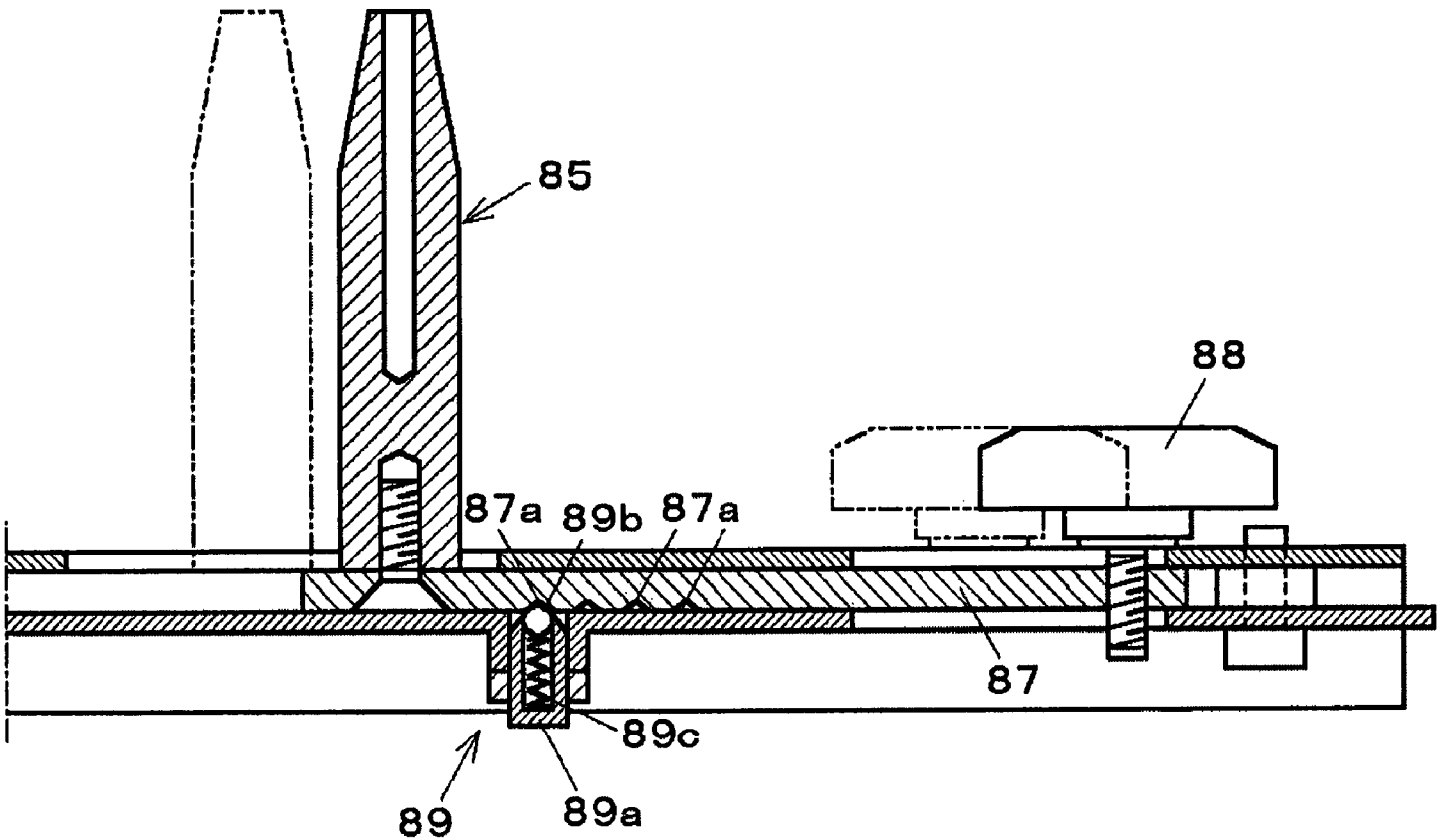
FIG. 9 is an enlarged view of the pins in accordance with the embodiment of the present invention, to show the structure where the space between the pins is adjustable.

Then, lock members 89, 89 are respectively fixedly attached to predetermined locations on the left and right sides of the attachment member 86. As shown in FIG. 9, each lock member 89 includes a case 89*a*, a ball 89*b*, and a spring 89*c*. The tip of the ball 89*b* can project out from the opening in the upper portion of the case 89*a*. The spring 89*c* urges the ball 89*b* toward the slide member 87. Recessed portions 87*a* . . . 87*a* are formed in four locations on the slide member 87 with a predetermined space therebetween. The recessed portions 87*a* . . . 87*a* are formed such that the tip of the ball 89*b* can engage therewith.

Thus, by operating the knob bolts 88, 88 to slide the slide members 87, 87 and engaging the balls 89*b*, 89*b* of the lock members 89, 89 with the recessed portions 87*a*, 87*a* of the slide members 87, 87, both pins 85, 85 can be moved perpendicular to the transport direction to predetermined positions. With this configuration, both pins 85, 85 can move between the positions illustrated by the solid lines and the positions illustrated by the dot-dash lines in FIG. 9. In other words, the space between both pin members 85, 85 can be adjusted.

Note, as shown in FIG. 8, long holes 85*a*, 85*a* are formed in the upper portions of the pins 85, 85 in the height direction in order to improve work efficiency when a plurality of large bags Y . . . Y are mounted on the mounting portions 80. An auxiliary mounting member 90 is channel shaped in cross-section (U-shaped), made of a wire or the like, and retains a predetermined plurality of large bags Y . . . Y via the holes Yb, Yb. Ends of the auxiliary mounting member 90 can be inserted in the holes 85*a*, 85*a*. In other words, the task of mounting the large bags Y . . . Y on the mounting portions 80 can be simplified by inserting both ends of the auxiliary mounting member 90 into the holes 85*a*, 85*a* and moving the large bags Y . . . Y toward the pins 85, 85.

The first support member 81 is linked to the chains 65, 65 on both left and right sides thereof via the attachment member 86 and brackets 91, 91 noted above.

In addition, as shown in FIGS. 5 to 7, a pair of left and right control members 92, 92 are erected on each rearmost fourth support member 84 in the transport direction h so as to interpose the large bags Y therebetween from the sides. The control members 92, 92 are approximately L-shaped when viewed from the front, and control the position of the large bags Y in a direction perpendicular to the transport direction. The space between the control members 92, 92 can be adjusted by operating knob bolts 93, 93. Description of the adjustment structure of the control member 92, 92 and the knob bolts 93, 93 will be omitted herein since it is similar to that of the knob bolt 88 and the oval hole 81*b* discussed above.

The second and third support members 82, 83 that are interposed between the first support member 81 and the fourth support member 84 have central portions that extend in a direction perpendicular to the transport direction that extend in a predetermined length and which are bent upward. The height of the bent central portions of the second and third support members 82, 83 are the same as the height of the first and fourth support portions 81, 84 (see, for example, FIG. 11 noted below).

In order for the chains 65, 65 to move along the circulation path shown in FIGS. 6 and 7, the pins 85, 85 provided on the mounting portions 80 point slightly diagonally upward in the mounting position N. In addition, the pins 85, 85 retain the front portions of the large bags Y . . . Y, which are illustrated by the dot-dash lines in an inclined posture relative to the vertical direction in FIGS. 6, 7. The mounting portions 80 are sized to be shorter in the transport direction than the large bags Y . . . Y. In this configuration, the rear portions of the large bags Y . . . Y hang down in an approximate perpendicular posture.

In addition, the pins 85, 85 provided on the mounting portions 80 point upward in the discharge position M, where the chains 65, 65 run in the horizontal direction. Furthermore, the front portion of the large bag Y . . . Y that is mounted on the mounting portions 80 is supported in a horizontal posture by the first to fourth support members 81-84. Here, the chains 65, 65, the mounting portions 80, and the first to fourth support members 81-84 are configured such that the rear portions of the large bags Y . . . Y hang out.

Horizontal Support Mechanism of the Bag Supply Device

Figure 10:
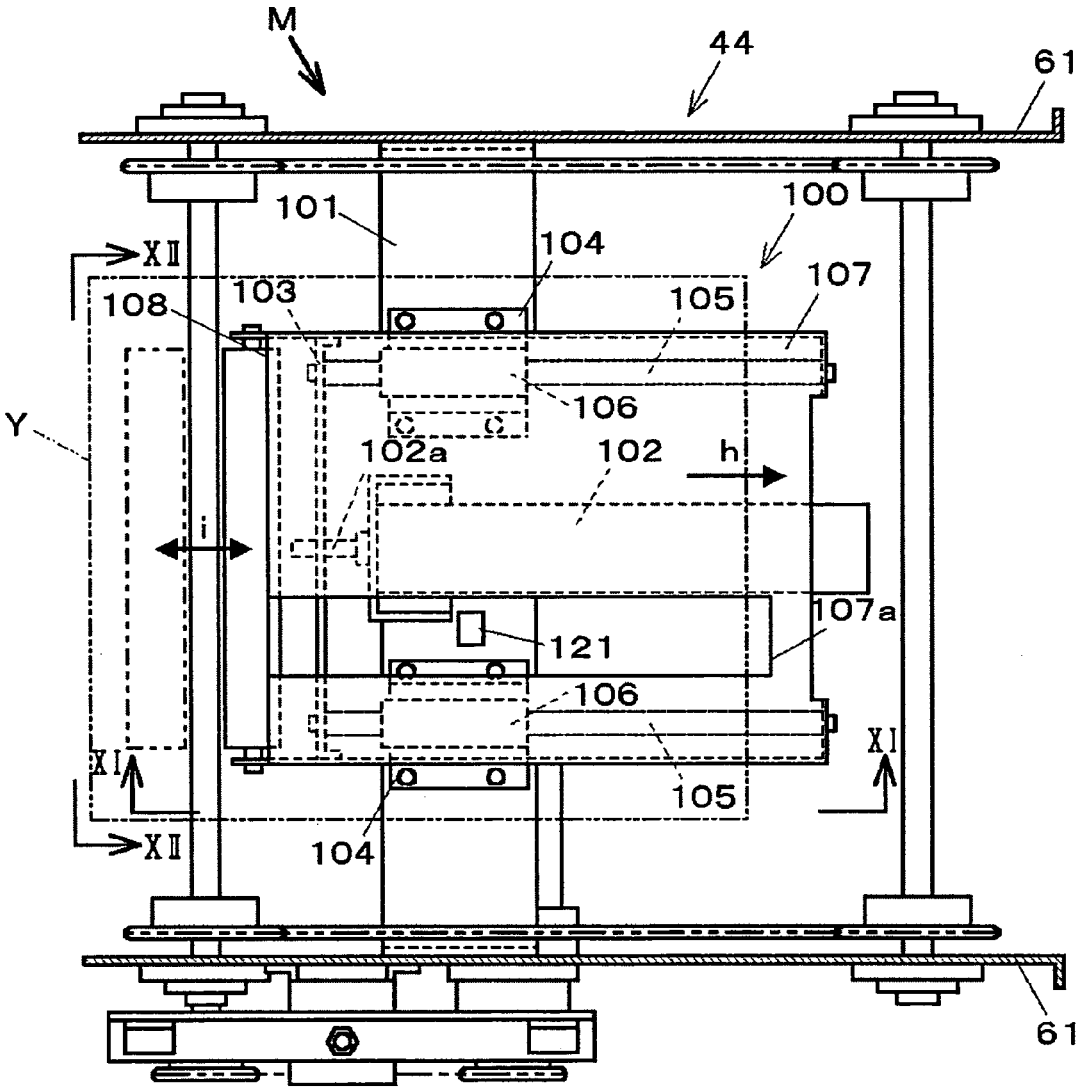
FIG. 10 is a view of the bag supply device in accordance with the embodiment of the present invention, viewed along a line X-X of FIG. 6.
Figure 11:
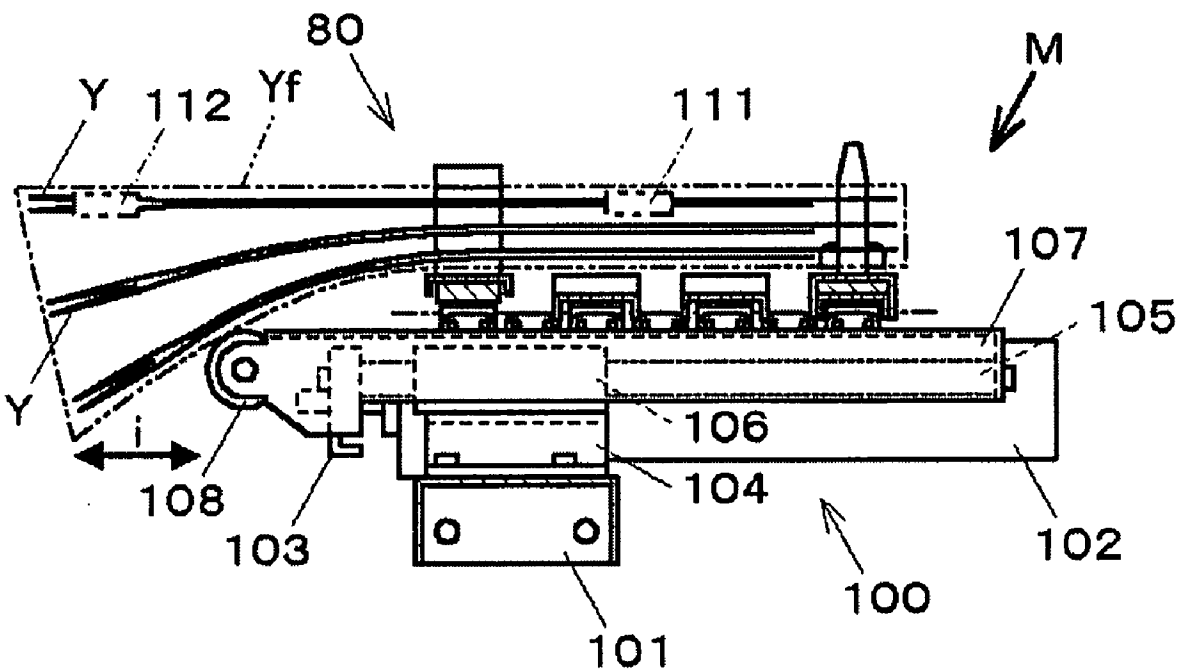
FIG. 11 is an enlarged view of the bag supply device and the horizontal support mechanism in accordance with the embodiment of the present invention, viewed along a line XI-XI of FIG. 10.
Figure 12:
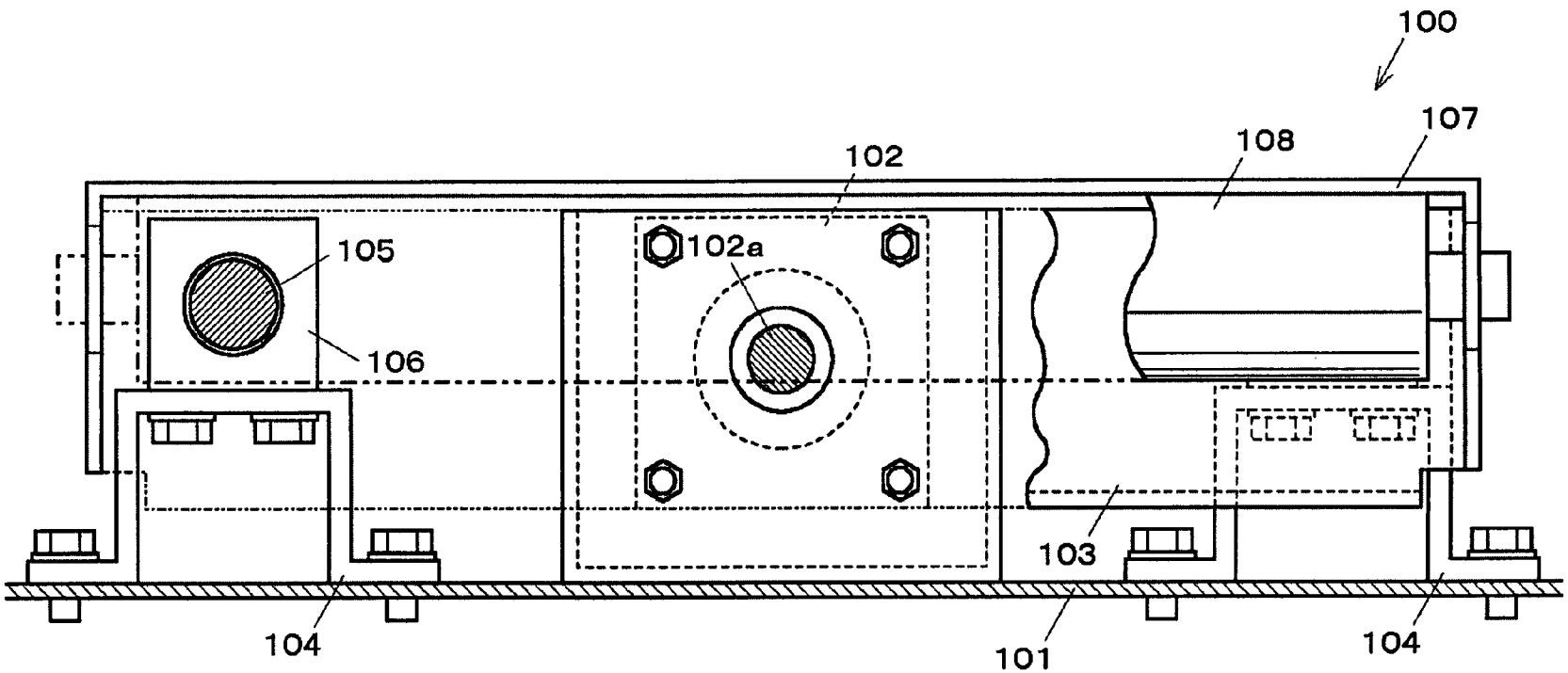
FIG. 12 is an enlarged view of the horizontal support mechanism in accordance with the embodiment of the present invention, viewed along a line XII-XII of FIG. 10.

As shown in FIGS. 10 to 12, a horizontal support mechanism 100 that retains the uppermost large bag Y in a horizontal posture at the discharge position M is provided in the bag supply device 44.

The horizontal support mechanism 100 is arranged on top of the support frame 101. The support frame 101 is a channel shaped (U-shaped) frame when viewed in cross-section, and is installed in between both side frames 61, 61 near the discharge position M. An electric cylinder 102 is disposed on the central upper surface of the support frame 101. In addition, an attachment member 103 that extends in a direction perpendicular to the transport direction is attached to the tip of a rod 102*a* of the electric cylinder 102. Furthermore, a pair of support members 104, 104 interposes the electric cylinder 102 and is fixedly attached to the upper surface of both left and right sides of the support frame 101. Guide members 106, 106 are fixedly coupled to the support members 104, 104. Guide rods 105, 105 that are long in the transport direction h extend through the guide members 106, 106. The attachment member 103 is fixedly attached to an approximately box-shaped support case 107. In addition, the front end of the guide rods 105, 105 are supported by the support case 107, and the rear ends of the guide rods 105, 105 are supported by the attachment member 103. Furthermore, a roller 108 (an example of the horizontal support means) that is long in the transport width direction is rotatively supported on the rear end of the support case 107.

When the rod 102*a* of the electric cylinder 102 extends or retracts, the roller 108 moves in horizontal directions indicated by the arrow i shown FIGS. 10, 11, such that the roller 108 moves unitarily with the attachment member 103 that is attached to the tip of the rod 102*a* and the support case 107 to which the attachment member 103 is fixedly attached. The roller 108 can support the rear portion of the large bags Y . . . Y at the discharge position M, where the rear portion of the large bags Y . . . Y is stretched from the bottom in a suitable position along the transport direction h.

As shown in FIGS. 5 and 6, a pair of first and second bag position sensors 111, 112 (an example of horizontal detection means) are provided on front and rear portions on the bag supply device 44. The first and second bag position sensors 111, 112 detect whether or not the uppermost large bag Y in the discharge position M is in the horizontal state.

The first and the second bag position sensors 111, 112 are disposed at the discharge portion M on side portions with respect to the transport direction h of the large bags Y . . . Y, and serve to detect the positions of the front portion and the rear portion in the vertical direction of the uppermost large bag Y from the side portions of the large bags Y . . . Y in the stacked state. More specifically, reflective photoelectric sensors are used as the first and second bag position sensors 111, 112. Since reflective photoelectric sensors are well-known to the ordinarily skilled in the art, further description or illustration of the first and second bag position sensors 111, 112 will be omitted herein. The first and second bag position sensors 111, 112 are attached to a shared attachment member 115. The shared attachment member 115 can be raised and lowered in the directions indicated by the arrow j by an electric cylinder 114. The electric cylinder 114 is fixedly attached to one of the side frames 61 via a bracket 113.

Bag Presence Sensor of the Bag Supply Device

As shown in FIGS. 5, 7 and 10, a first bag presence sensor 121 that detects the presence of large bags Y at the discharge position M, and a second bag presence sensor 122 that detects the presence of large bags Y at the mounting position N, are provided in the bag supply device 44. The first bag presence sensor 121 and the second bag presence sensor 122 are respectively arranged in predetermined locations via brackets not shown in the figures. More specifically, the first bag presence sensor 121 and the second bag presence sensor 122 are arranged such that the first to fourth support members 81-84 of the mounting portion 80 will not be positioned between the bag presence sensors 121, 122 and the large bags Y when the chains 65, 65 stop moving. Reflective photoelectric sensors are used as the first and second bag presence sensors 121, 122. Since reflective photoelectric sensors are well-known to the ordinarily skilled in the art, further description or illustration of the first and second bag presence sensors 121, 122 will be omitted herein. Note that the first bag presence sensor 121 is positioned above the support frame 101 and below the support case 107 of the horizontal support mechanism 100. In addition, a rectangular cut-out portion 107*a* that extends in the transport direction is formed in the upper surface of the support case 107, so that the first bag presence sensor 121 can face the large bags Y and detect the presence or absence thereof.

Bag Transportation Mechanism Between the Bag Supply Device and the Bagging Station As shown in FIG. 3, a bag transportation mechanism 130 is provided between the bag supply device 44 and the bagging station 43. The bag transportation mechanism 130 transports empty large bags Y that are discharged one by one from the bag supply device 44 to the bagging position L of the bagging station 43 at the discharge position M.

As shown in FIGS. 3 and 4, the bag transportation mechanism 130 includes a base 131 that is installed between left and right upper frames 40*a*, 40*a* (only one shown in FIG. 3). The base 131 is movable forward and backward on the upper frames 40*a* in the directions indicated by the arrow k by a drive source not shown in the figures. An electric cylinder 132 is mounted on the base 131. Linear guides 133, 133 are fixedly attached to the side portions of the electric cylinder 132. A plate member 134 that deploys horizontally is attached to the tip of a rod of the electric cylinder 132. In addition, guide rods 135, 135 erected on the frame member 134 extend through the linear guides 133, 133, and the plate member 134 is vertically movable in the directions indicated by the arrow m by operation of the electric cylinder 132. First and second vacuum pumps 136, 137 are provided on the upper surface of the base 131.

Figure 13:
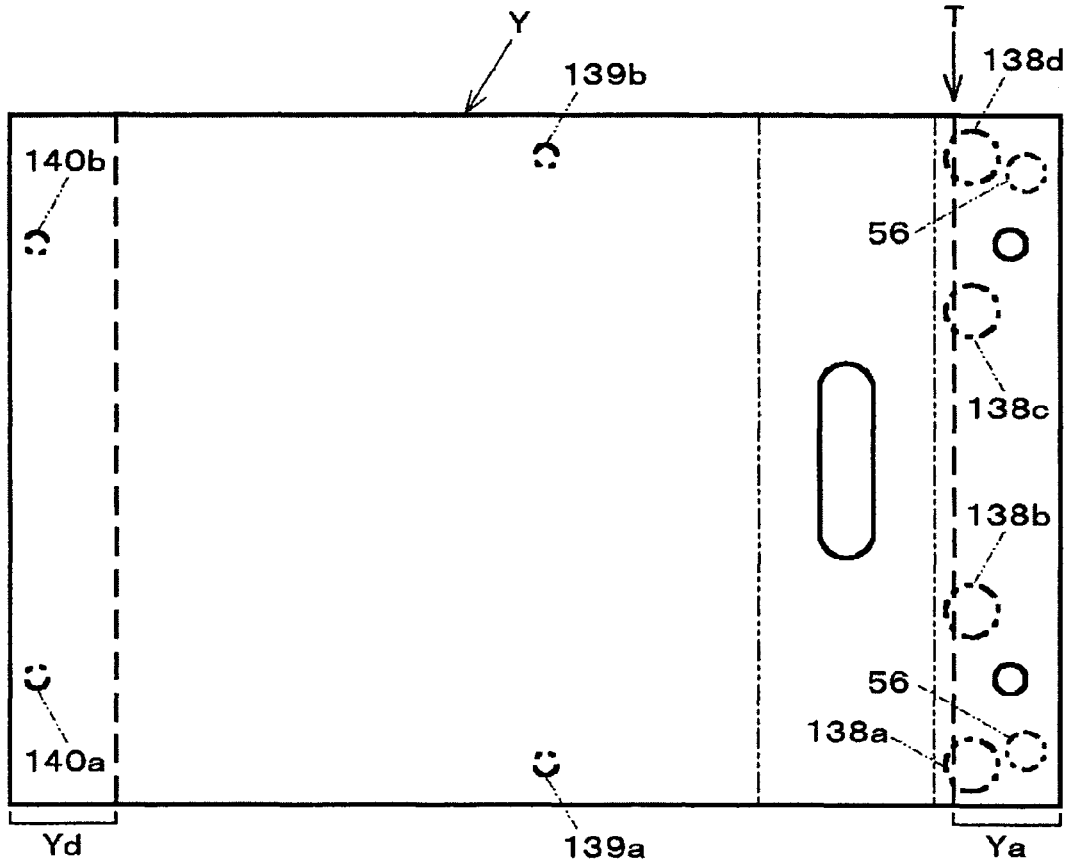
FIG. 13 is a plan view of a large bag, showing suction gripping locations thereon.

A plurality of suction portions 138, 139, 140 is assembled on the lower surface of the plate member 134. Each suction portion 138, 139, 140 grips the upper surface of a large bag Y by suction. As shown in FIG. 13, four suction portions 138*a*-138*d* closest to the bagging station 43 grip an area near the end portion of a large bag Y in which the opening T is formed. Two suction portions 139*a*, 139*b* that are positioned in the central portion in the horizontal direction of the plate member 134 grip the area near both left and right side edges of a large bag Y. Two suction portions 140*a*, 140*b* furthest from the bagging station 43 grip the area near the end portion of a large bag Y in which the fold Yd is formed. From amongst each suction portion 138, 139, 140, the suction portions 138*b*, 138*c*, 140*a*, and 140*b* are connected to the first vacuum pump 136. The suction portions 138*a*, 138*d*, 139*a*, 139*b* are connected to the second vacuum pump 137. The suction portion 138 has the shape of a suction cup. The suction portions 139, 140 have an accordion-like shape. As shown in FIG. 3, the suction portion 138 is configured such that the position thereof in its natural state is higher than the positions of the suction portions 139, 140.

Control System for Bag Supply Device

Figure 14:
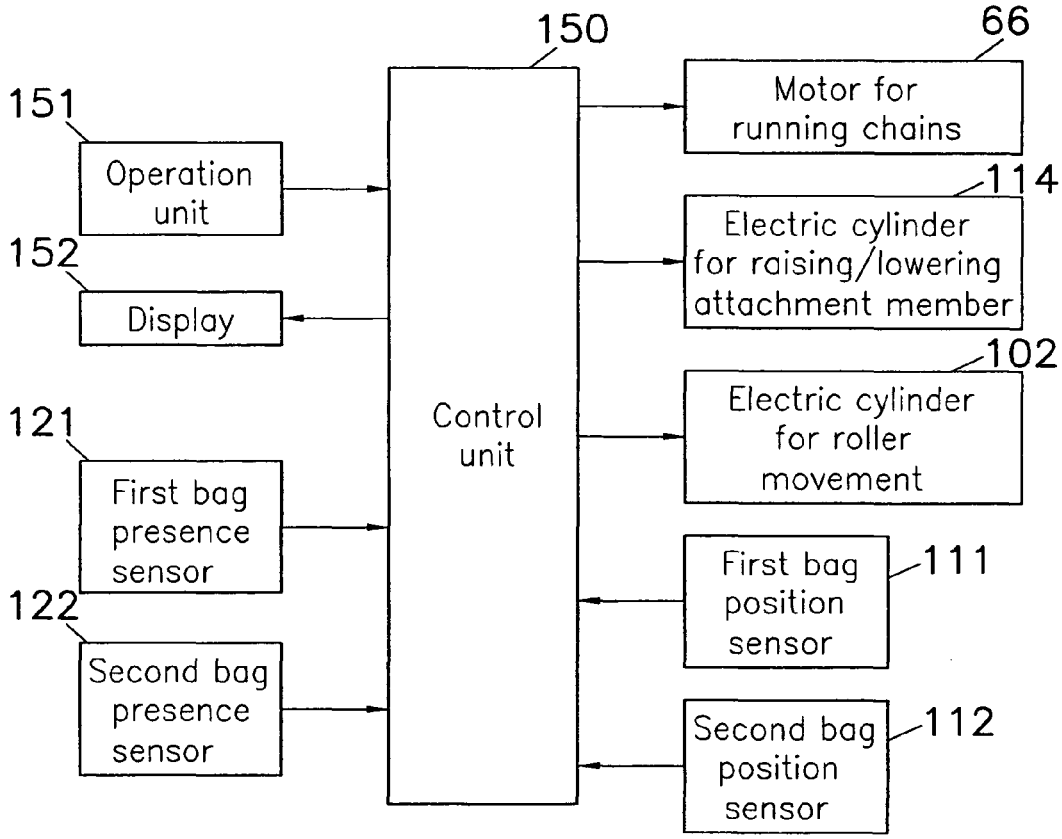
FIG. 14 is a schematic view showing a control system of the bag supply device in accordance with the embodiment of the present invention.

Next, the control system for the bag supply device 44 will be described. As shown in FIG. 14, a control unit 150 that conducts overall control of the bag supply device 44 inputs operation signals from an operation unit 151 in order to conduct various operations, and displays various data on a display 152.

A control unit 150 (an example of control means) preferably includes a microcomputer with a control program that controls various components as discussed below. The control unit 150 can also include other conventional components such as an input interface circuit, an output interface circuit, and storage devices such as a ROM (Read Only Memory) device and a RAM (Random Access Memory) device. The control unit 150 is operatively coupled to the operation unit 151, the display 152, the first bag presence sensor 121, the second bag presence sensor 122, the motor 66, the electric cylinders 114 and 102, and the first and second bag position sensors 111 and 112 in a conventional manner. The control unit 150 is capable of selectively controlling any of the components operatively coupled to the control unit 150 in accordance with the control program. It will be apparent to those skilled in the art from this disclosure that the precise structure and algorithms for control unit 150 can be any combination of hardware and software that will carry out the functions of the present invention. In other words, "means plus function" clauses as utilized in the specification and claims should include any structure or hardware and/or algorithm or software that can be utilized to carry out the function of the "means plus function" clause.

In addition, the control unit 150 inputs detection signals from the first and second bag position sensors 111, 112, and based upon these detection signals, outputs control signals at a suitable timing to the electric cylinder 114 that raises and lowers the attachment member 115 on which the first and second bag position sensors 111, 112 are attached, and to the electric cylinder 102 that moves the roller 108 to support the rear portion of the large bags Y . . . Y in the discharge position M.

Then, the control unit 150 inputs detection signals from the first and second bag presence sensors 121, 122, and based upon these detection signals, outputs control signals at a suitable timing to the motor 66 that circulates the chains 65, 65 on which the mounting portions 80 . . . 80 are arranged.

Special Characteristics and Operation of the Bagging Device

Next, the special characteristics and an example of the operation of the bagging device 40 will be described.

Special Characteristics of the Bag Supply Device

First, the special characteristics of the configuration of the bag supply device 44 will be described.

Here, the four mounting portions 80 . . . 80 are arranged in a predetermined spaced relationship in the transport direction h, and the chains 65, 65 that transport the stacked large bags Y . . . Y are disposed such that the chains 65, 65 circulate along a path that extends in a generally vertical direction shown in FIG. 7. Then, the discharge position M is placed in the upper horizontal location, and the mounting position N is placed diagonally below the discharge position M.

Then, while the chains 65, 65 are stopped, a plurality of large bags Y . . . Y is mounted on the mounting portion 80 at the mounting position N in the bag supply device 44. Then, the mounting portion 80 moves upward to the discharge position M.

Special Characteristics and Operation of the Bag Transportation Mechanism

Next, an example of the operation of the bag transportation mechanism 130 will be described.

Figure 15:
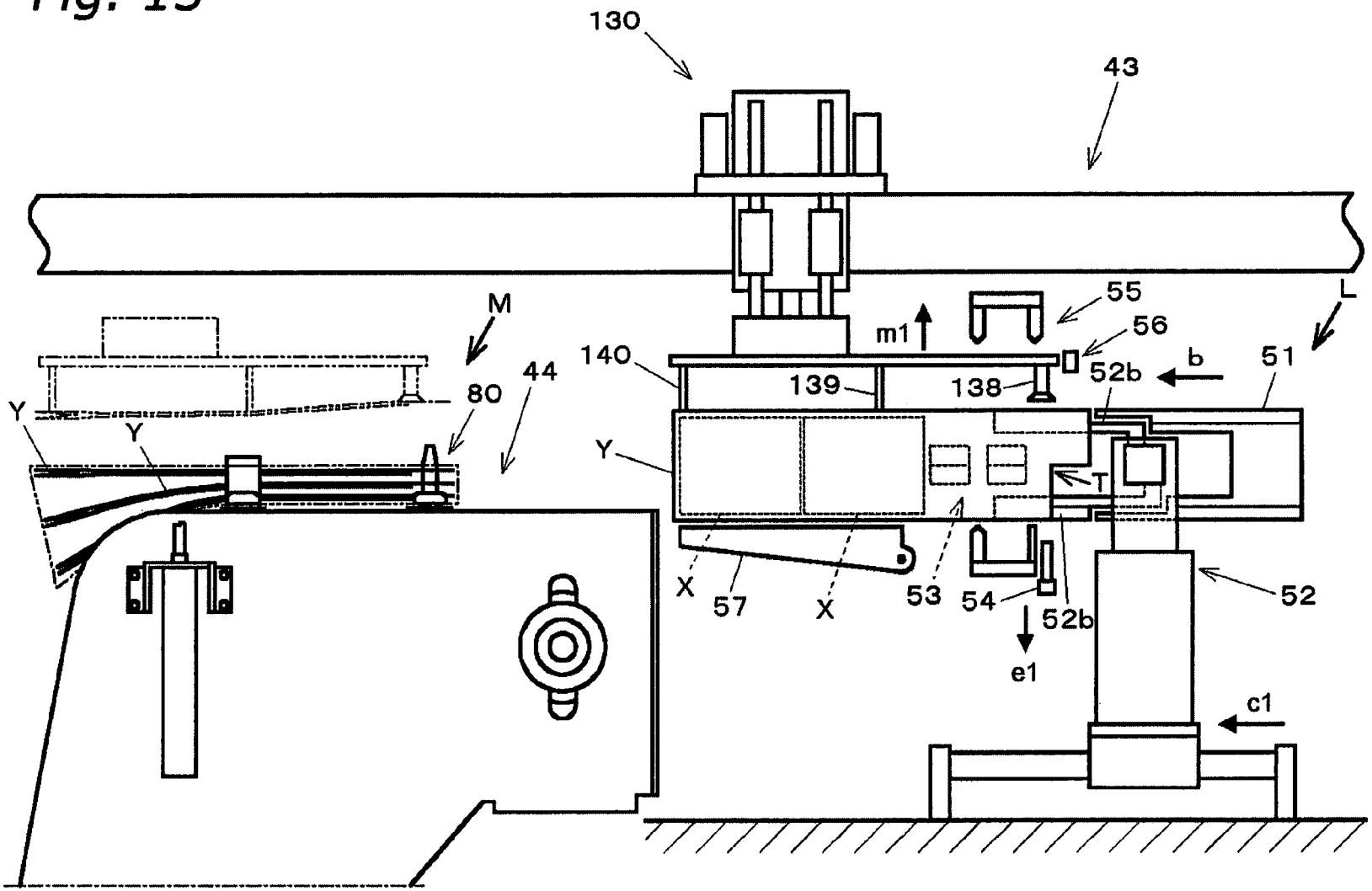
FIG. 15 is a lateral schematic view of the bagging station in accordance with the embodiment of the present invention, showing the bagging process.

As shown in FIG. 15, the suction portions 138, 139, 140 of the bag transportation mechanism 130 positioned above the bag supply device 44 descend down toward the mounting portion 80 of the bag supply device 44 stopped at the discharge position M, and after coming into contact with the uppermost large bag Y stacked on the mounting portion 80, grip the uppermost large bag Y by suction. When this occurs, the suction portions 138, 139, 140 suction the large bag Y at the location shown in FIG. 13. Then, as shown by the dot-dash lines, the suction portions 138, 139, 140 raise the large bag Y while gripping it by suction.

When the suction portions 138, 139, 140 that grip the large bag Y by suction move in the horizontal direction from the discharge position M toward the bagging position L of the bagging station 43, the suction portions 138, 139, 140 will then descend at the same time the lower side suction portion 54 rises, and the bag transportation process will be complete.

Special Characteristics and Operation of the Horizontal Support Mechanism

In the bag support device 44, because the uppermost large bag Y is retained in the horizontal posture in the mounting portion 80 of the discharge device M by the horizontal support mechanism 100, the bag transportation mechanism 130 (suction portions 138, 139, 140) will correctly come into contact with the large bag Y. Thus, because the suction gripping by the suction portions 138, 139, 140 stabilizes the large bag Y, discharge errors will be reduced, the discharge of the large bags Y will be smoothly performed, and production efficiency will be improved.

The horizontal support operation of the large bags Y by the horizontal support mechanism 100 based upon the detection signals from the first and second bag position sensor 111, 112 will be described in detail. As shown in FIG. 11, the rear portion of the plurality of large bags Y . . . Y retained on the mounting portion 80 in the discharge position M hang over the end of the mounting portion 80. Then, the uppermost large bag Y is retained in the horizontal position by retaining the rear portion of the plurality of large bags Y . . . Y from below at the optimal position in the horizontal direction with the roller 108 of the horizontal support mechanism 100. Then, the first and second bag position sensors 111, 112 positioned on the sides of the large bags Y . . . Y are arranged such that they respectively detect the vertical position of the front and rear portions of the uppermost surface Yf of the uppermost large bag Y. In the example shown in the figures, because the uppermost large bag Y is retained in the horizontal posture, the bag position sensors 111, 112 respectively detect the front portion and rear portion of the uppermost large bag Y.

Figure 16:
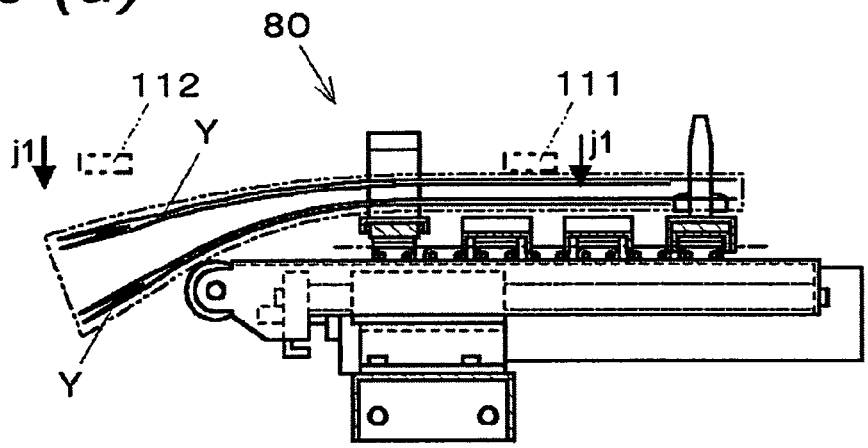
FIGS. 16 are enlarged views of the bag supply device and the horizontal support mechanism in accordance with the embodiment of the present invention, showing the operation of the horizontal support mechanism, (a) showing the uppermost large bag not being retained in a horizontal posture, (b) showing the first and second bag position sensors in the lowered state, and (c) showing the uppermost large bag being retained in a horizontal posture.
Figure 16:
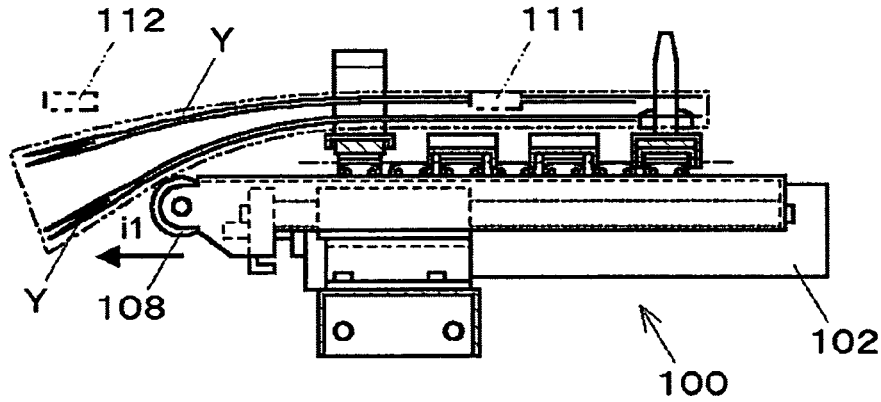
Figure 16:
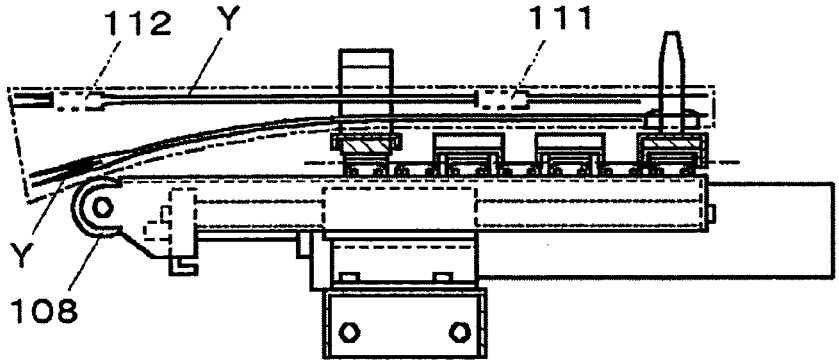

As shown in FIG. 16(*a*), the position in the vertical direction of the uppermost large bag Y will become lower as the discharge of the large bags Y . . . Y from the mounting portion 80 proceeds. At the same time, the uppermost large bag Y will no longer be supported in the horizontal posture, and the rear portion thereof will hang down. When this occurs, the first and second bag position sensors 111, 112 will no longer detect the front portion and rear portion of the uppermost large bag Y.

In this situation, the control unit 150 will execute the following control based upon the detection signals input from the first and second bag position sensors 111, 112. In other words, the first bag position sensor 111 will observe the position in the vertical direction of the upper surface of the front portion of the large bag Y stacked on the mounting portion 80. Then, as noted above, when the first bag position sensor 111 does not detect the upper surface of the large bag Y, the drive of the electric cylinder 114 is controlled to cause the attachment member 115 on which the first bag position sensor 111 is installed to descent, so that the first bag position sensor 111 will descend in the direction indicated by the arrow j1 to a position in which it can detect the upper surface of the large bag Y. Because the second bag position sensor 112 is also installed on the attachment member 115, the second bag position sensor 112 will descend simultaneously with the first bag position sensor 111.

As shown in FIG. 16(*b*), the first bag position sensor 111 will descend to a position in which it can detect the upper surface of the front portion of the uppermost large bag Y. In this situation, because the rear portion of the large bags Y . . . Y hangs down, the second bag position sensor 112 will be positioned above the upper surface of the large bag Y and cannot detect the upper surface of the rear portion of the large bag Y.

Thus, when the first bag position sensor 111 detects the upper surface of the front portion of the uppermost large bag Y, and the second bag position sensor 112 does not detect the upper surface of the rear portion of the uppermost large bag Y, the control unit 150 controls the drive of the electric cylinder 102 of the horizontal support mechanism 100. Due to this control, the roller 108 that supports the rear portion of the large bags Y . . . Y from the bottom extends outward in the direction indicated by the arrow i1, the rear portion of the large bags Y . . . Y rises upward, and the second bag position sensor 112 will detect the upper surface of the rear portion of the uppermost large bag Y.

Then, as shown in FIG. 16(*c*), the rear portion of the large bags Y . . . Y is supported in the optimal position by the roller 108, the first and second bag position sensor 111, 112 respectively detect the upper surface of the front portion and rear portion of the uppermost large bag Y, and the uppermost large bag Y is supported in the horizontal posture. Thus, the suction portions 138, 139, 140 of the bag transportation mechanism 130 will correctly come into contact with the uppermost large bag Y, and the suction gripping of the large bag Y by the suction portions 138, 139, 140 will be stabilized. Because of this, discharge errors will be reduced, the discharge of the large bag Y will be smoothly performed, and production efficiency will be improved. In particular, as shown in the present embodiment, the horizontal support mechanism 100 configured so that the support position of the rear portion of the large bags Y can be optimized will effectively move when the rear portion of the large bags Y . . . Y hang down from the discharge position M. In other words, as shown in the present embodiment, the total thickness of the large bags Y in the stacked state will be greatly different at the front portion and the rear portion thereof, and the position in the vertical direction of the large bags Y will be different at the front portion and rear portion thereof. Thus, when additional large bags Y are discharged and there is a need to retain the horizontal posture of the uppermost large bag Y when discharging, the horizontal support mechanism 100 and the bag position sensors 111, 112 will be placed in effective locations.

In addition, empty space is created between the adjacent mounting portions 80, 80 because the four mounting portions 80, 80 are arranged on the chains 65, 65 spaced apart by a predetermined distance. In other words, when the uppermost large bag Y is adjusted by the horizontal support mechanism 100 so as to be placed in a horizontal posture, a configuration in which there is no interference between the mounting portions 80 (the first to fourth support members 81-84) and the moving roller 108 is easily achieved.

Furthermore, with the horizontal support mechanism 100, a large increase in costs will not occur because a method is adopted that supports the rear portion of the large bags Y . . . Y with a member having a simple structure.

Special Characteristics and Operation of the Bag Position Sensors

Because the first and second bag position sensors 111, 112 are installed on the shared attachment member 115, when for example the first bag position sensor 111 detects the uppermost large bag Y and the second bag position sensor 112 does not detect the uppermost large bag Y, it can be easily determined that the uppermost large bag Y is not in the horizontal state. Moreover, because the raising and lowering of the bag position sensors 111, 112 is accomplished by the electric cylinder 114 via the attachment member 115, the raising and lowering mechanism can be simplified.

In addition, the method of detecting the upper surface of the front and rear portions of the uppermost large bag Y by both of the bag position sensors 111, 112 is a method which detects the position in the vertical direction of the large bag Y from the side portions of the large bag Y. Because of this, the sensor structure will generally become simpler and the detection accuracy will improve, compared to when, for example, the bag position sensors are disposed above the uppermost large bag Y and detect the vertical position of the uppermost large bag Y by measuring the distance up to the large bag Y.

The bag supply device 44 includes the first and second bag presence sensors 121, 122, which are respectively disposed in the vicinity of the discharge position M and the mounting position N and detect the presence or absence of a large bag Y. The control unit 150 into which detection signals from the bag presence sensor 121, 122 are input is configured to control the operation of the chains 65, 65 based upon these detection signals.

In the present embodiment, the leading mounting portion 80 is in the discharge position M, and the next successive mounting portion 80 is positioned in the mounting position N. Because of this, when large bags Y . . . Y are not detected in the discharge position M by the first bag presence sensor 121 and the large bags Y are detected in the mounting position N by the second bag presence sensor 122, the drive of the motor 66 will be controlled to cause the chains 65, 65 to rotate so that the mounting portion 80 in the mounting position N on which the large bags Y . . . Y are mounted will move to the discharge position M. Thus, the replenishment of the large bags Y . . . Y in the discharge position M can be automated. Note also that when the large bags Y are not detected in the discharge position M and the large bags Y . . . Y are not detected in the mounting position N, an alert will be generated that, for example, displays an error message on the display 152 so that replenishment can be hastened.

Operational Examples (Control Examples) for the Bag Supply Device

Figure 17:
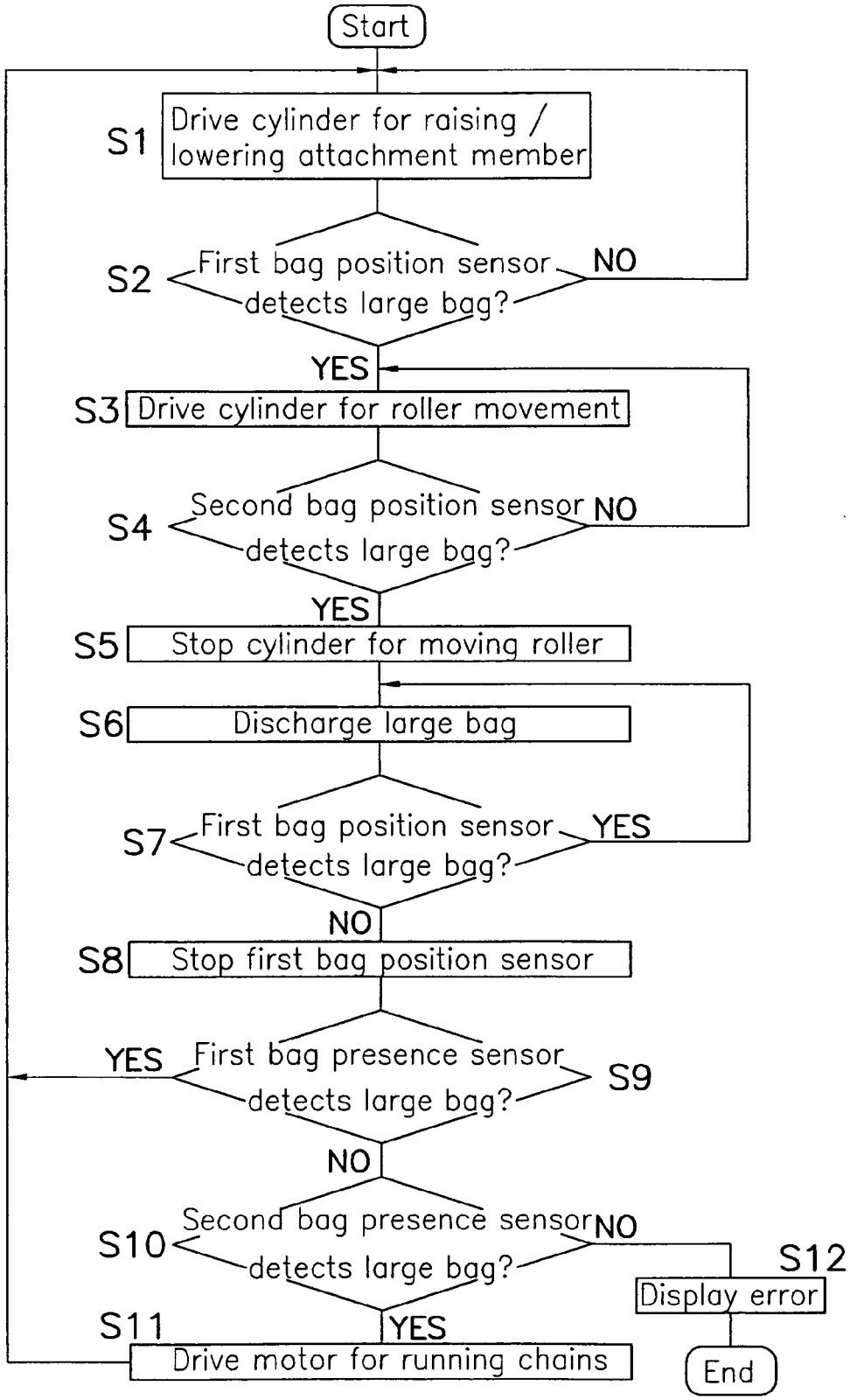
FIG. 17 is a flowchart of an example of the control performed by the control unit in accordance with the embodiment of the present invention.

Next, an example of the control of the bag supply device 44 by the control unit 150 will be described based upon the flowchart shown in FIG. 17.

The first and second bag position sensors 111, 112 are set in home positions that are higher than the vertical position of the upper surface of the uppermost large bag Y. First, in Step S1, the control unit 150 drives the electric cylinder 114 to cause the attachment member 115 on which the bag position sensors 111, 112 are installed to descend.

In Step S2, it is determined whether or not the first bag position sensor 111 has detected the upper surface of the front portion of the uppermost large bag Y, and if the determination is NO, the process returns to Step S1 and the drive of the electric cylinder 114 will continue. If the determination in Step S2 is YES, then the descent of the attachment member 115 is stopped and the process proceeds to Step S3.

The rear portion of the stacked large bags Y . . . Y in the discharge position M hangs downward, and is supported from bellow by the roller 108 so that the rear portion can be raised and lowered. In Step S3, the electric cylinder 102 is driven, and causes the roller 108 to move in the direction indicated by the arrow i1 so that the rear portion of the large bags Y . . . Y rises.

In Step S4, it is determined whether or not the second bag position sensor 112 has detected the upper surface of the rear portion of the uppermost large bag Y, and if the determination is NO, the process returns to Step S3 and the drive of the electric cylinder 102 will continue. If the determination is YES, then the process proceeds to Step S5, and the drive of the electric cylinder 102 will stop. In the latter situation (when the determination is YES in Step S4), after the first and second bag position sensors 111, 112 both detect the uppermost large bag Y, the roller 108 will be in the optimal position in the horizontal direction, and the uppermost large bag Y will be retained in the horizontal state.

When the uppermost large bag Y is retained in the horizontal posture, the process will proceed to Step S6, and the discharge and transport of the uppermost large bag Y by the bag transportation mechanism 130 will be executed.

Next, the process will proceed to Step S7, and during the time period in which the first bag position sensor 111 detects the upper surface of the front portion of the uppermost large bag Y, the process will return to Step S6 and the discharge of the large bag Y will continue. If in Step S7 the first bag position sensor 111 does not detect the upper surface of the front portion of the uppermost large bag Y, in other words, if the position in the vertical direction of the uppermost large bag Y descends as discharge proceeds, then the process will proceed to Step S8 and the discharge of the large bags Y will stop.

Then, in Step S9, it is determined whether or not the first bag presence sensor 121 has detected large bags Y in the mounting portion 80 at the discharge position M, and if the determination is YES, then the process returns to Step S1, the electric cylinder 114 is driven to cause the first bag position sensor 111 to descend, and further control is executed.

If the determination in Step S9 is NO, then in that situation it means that there are no large bags Y retained to be discharged at the discharge position M, and thus the process proceeds to Step S10. Note that the first and second bag position sensor 111, 112 are raised to the predetermined home position and wait for further instructions.

In Step S10, it is determined whether or not the second bag presence sensor 122 has detected a large bag Y in the mounting portion 80 of the mounting position N, and if the determination is YES, the process proceeds to Step S11. In Step S11, the mounting portion 80 is moved from the mounting position N to the discharge position M by driving the motor 66 and causing the chains 65, 65 to run, and the process will then return to Step S1. This allows the large bags Y to be automatically replenished.

If the determination in Step S10 is NO, then the process proceeds to Step S12. In Step S12, an error message, for example, is displayed on the display 152, and the operation of the bagging device 40 will be stopped.

Note that if controlled as described above, it is determined whether or not the first bag position sensor 111 has detected a large bag Y each time the discharge of a large bag Y is performed. However, for example, it may be determined whether or not the first bag position sensor 111 has detected a large bag Y after a predetermined period of time has expired since the previous detection.

In addition, because reflective photoelectric sensors are used as the first and second bag presence sensors 111, 112, and the first and second bag presence sensors 121, 122, the structure will be simplified compared to transmission type photoelectric sensors, and moreover, a large increase in costs will not occur.

Operational Example of the Bagging Station

Next, an example of the operation of the bagging station 43 will be described with reference to FIG. 15.

As indicated by the solid lines, after the suction portions 138, 139, 140 descend and the lower side suction mechanism 54 is raised simultaneously, the bag edge gripping mechanism 53 operates to grip both left and right side edges of a large bag Y. Next, the opening T will be slightly opened by raising the suction portions 138, 139, 140 in the direction indicated by the arrow m1, and lowering the bottom side suction portion 54 in the direction indicated by the arrow e1 simultaneously therewith. Then, the bag opening device 52 moves forward toward the large bag Y in the direction indicated by the arrow c1, and the four bag opening members 52*b* . . . 52*b* are inserted into the large bag Y. At this point, the discharge flap 57 will pivot upward. The bag opening members 52*b* . . . 52*b* inserted therein act to expand the interior of the large bag Y.

When the interior of the large bag Y is expanded to a predetermined size, a group of small bags X . . . X collected and aligned into 2 rows of 6 bags pass through the small bag insertion guide 51 in the direction indicated by the arrow b and are inserted into the large bag Y. When the insertion is completed, the bag opening members 52*b* . . . 52*b* are operated to contract, and the bag opening device 52 is retracted. Then, the horizontal seal mechanism 55 operates to form the horizontal seal locations S1, S2 on the large bag Y. After that, the bag extension clamping member 56 descends, and as shown in FIG. 13, the extension Ya of the large bag Y cut during horizontal sealing is clamped from above. A bagged item Z will be obtained when the discharge flap 57 is pivoted downward while the bag extension clamping member 56 clamps the extension Ya, and the bagged item Z is transferred to the discharge device 45 in the vertical posture with the opening T on top.

Thus, production efficiency will improve because the bagging device 40 includes the bag supply device 44 having the special characteristics noted above.

Other Special Characteristics of the Bag Supply Device

Here, other special characteristics of the bag supply device 44 will be described.

(1) Because the interval from the mounting position N to the discharge position M of the bag supply device 44 is vertical, the length or the width of the bag supply device 44 can be shorter than compared to a conventional horizontal interval that extends in the horizontal direction, and the bag supply device 44 can be smaller and more compact.

(2) The task of mounting the large bags Y . . . Y is simplified because the large bags Y . . . Y are retained on the mounting portions 80 by a method in which the pair of pins 85, 85 are inserted into the holes Yb, Yb provided in the front portion of the large bags Y . . . Y. Moreover, even if the spacing between the pair of holes Yb, Yb provided in the front portion is changed according to the width of the large bags Y to be mounted, a versatile bag supply device 44 that can be adjusted in accordance with the measurements of the large bags Y can be achieved because the spacing between both pins 85, 85 can be changed in response to that spacing.

(3) The task of, for example, manually mounting the large bags Y . . . Y on the mounting portion 80 is simplified because the pins 85, 85 in the mounting position N retain the front portion of the large bags Y . . . Y in an inclined posture.

(4) As shown in the present embodiment, with so-called gusset type large bags Y that are provided with a fold Yd in the bottom portion (here, rear portion) thereof and have multiple layers, when the large bags Y are stacked together, as indicated by the dot-dash lines in FIG. 7, the total thickness of the rear portion thereof is comparatively larger than the front portion thereof. As a result, if the pins 85, 85 retain the large bags Y . . . Y in a vertical posture in the mounting position N, there is a possibility that the mounted large bags Y . . . Y will fall off from the pin members 85, 85 because the rear portion having an expanded thickness will move away from the chains 65, 65 and the mounting portion 80. In contrast, if the pins 85, 85 retain the front portion of the large bags Y . . . Y in the inclined posture as in the present embodiment, problems such as the large bags Y . . . Y falling off from the pins 85 . . . 85 can be effectively avoided, and thus production efficiency will be improved, because force will be applied on the large bags Y . . . Y in the direction of the chains 65, 65 and the mounting portion 80.

(5) Because the rear portion of the large bags Y . . . Y whose front portion is retained by the pins 85, 85 in the mounting position N hang down in an approximately perpendicular posture, the boundary between the front portion of the large bags Y . . . Y that are retained in the inclined posture as noted above and the rear portion thereof that hang down in an approximate perpendicular posture will act as a fulcrum to apply force to the rear portion of the large bags Y . . . Y toward the chains 65, 65 and the mounting portion 80. As a result, the large bags Y . . . Y will be reliably retained by the pins 85, 85.

(6) The mounting portion 80 includes the first to fourth support members 81-84 that support the large bags Y . . . Y from the bottom surface thereof, the pins 85, 85 that are arranged on the forward-most first support member 81 in the transport direction h, and the control members 92, 92 that control the movement of the large bags Y . . . Y in the direction perpendicular to the transport direction and are arranged on the rearmost fourth support member 84. Because of this, the large bags Y . . . Y mounted on the mounting portion 80 will be correctly positioned, the posture of the large bags Y . . . Y will be stable, and the discharge of the large bags Y . . . Y in the discharge position M will be smoothly performed.

(7) The four mounting portions 80 . . . 80 are spaced such that when the leading mounting portion 80 is in the discharge position M, the next successive mounting portion 80 is positioned in the mounting position N. Accordingly, if the chains 65, 65 are stopped when the leading mounting portion 80 on which a plurality of large bags Y . . . Y are mounted is in the discharge position M, the control unit 150 will position the next successive mounting portion 80 in the mounting position N. Thus, while the leading mounting portion 80 is in the discharge position M and the large bags Y . . . Y are being discharged, new large bags Y . . . Y can be mounted on the next successive mounting portion 80 that is positioned in the mounting position N. Because of this, even if the discharge of a large bag Y by the bag transport mechanism 130 is not stopped for replenishment as is done conventionally, the large bags Y . . . Y can be replenished and production efficiency will improve.

(8) The bag supply device 44 includes the first and second bag presence sensors 121, 122, which are adjacent to the discharge position M and the mounting position N and detect the presence or absence of a large bag Y. In addition, the control unit 150 into which detection signals from the bag presence sensors 121, 122 are input is configured to control the operation of the chains 65, 65 based upon the detection signals.

In the present embodiment, because the leading mounting portion 80 is in the discharge position M when the next successive mounting portion 80 is in the mounting position N, when large bags Y are not detected in the discharge position M by the first bag presence sensor 121 and the large bags Y are detected in the mounting position N by the second bag presence sensor 122, the drive of the motor 66 will be controlled to cause the chains 65, 65 to travel so that the mounting portion 80 in the mounting position N on which the large bags Y . . . Y are mounted will move to the discharge position M. Thus, the replenishment of the large bags Y . . . Y in the discharge position M can be automated. When the large bags Y are not detected in the discharge position M and the large bags Y are not detected in the mounting position N, an alert will be generated that, for example, displays an error message on the display 152 so that replenishment can be hastened.

Note also that in the present embodiment, although the large bags Y are so-called gusset type bags in which the fold Yd is provided in the bottom portion of each, it goes without saying that the same effect as noted above will be obtained even if large bags of other types, such as ones that do not have a fold are used.

According to the present invention, a packaging bag supply device and a bagging device having the same are broadly suitable for the article packaging field and can improve production efficiency are provided. In other words, the present invention relates to a packaging bag supply device that supplies packaging bags to a discharge position, and to a bagging device that has the packaging bag supply device and discharges one bag at a time in the discharge position and bags articles at a bagging position.

As used herein, the following directional terms "forward, rearward, above, downward, vertical, horizontal, below and transverse" as well as any other similar directional terms refer to those directions of a device equipped with the present invention. Accordingly, these terms, as utilized to describe the present invention should be interpreted relative to a device equipped with the present invention.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

This application claims priority to Japanese Patent Applications No. 2003-132980, No. 2003-132981, and 2003-132982. The entire disclosure of Japanese Patent Application No. 2003-132980, No. 2003-132981, and 2003-132982 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. A packaging bag supply device that supplies packaging bags to a packaging bag discharge position one by one, comprising:

transportation means that transports a plurality of stacked packaging bags from a mounting position to the discharge position;

horizontal support means that supports the plurality of stacked packaging bags such that an uppermost surface of an uppermost packaging bag is retained in a horizontal posture at the discharge position; and control means that controls the horizontal support means such that the uppermost surface of the uppermost packaging bag is supported in the horizontal posture.

2. The packaging bag supply device set forth in claim 1, wherein the horizontal support means supports a rear portion of the packaging bags at the discharge position.

3. The packaging bag supply device set forth in claim 1, wherein the horizontal support means includes a support roller.

4. The packaging bag supply device set forth in claim 1, wherein the transportation means includes a first mounting portion to which the packaging bags are adapted to be mounted at the mounting position.

5. The packaging bag supply device set forth in claim 4, wherein the first mounting portion does not interfere with the horizontal support means when the control means controls the horizontal support means to retain the uppermost surface of the uppermost packaging bag in the horizontal posture.

6. The packaging bag supply device set forth in claim 4, wherein the first mounting portion is adapted to mount the packaging bags in a substantially vertical posture at the mounting position; and the transportation means includes an endless member such that the packaging bags are transported from the mounting position to the discharge position by the endless member.

7. The packaging bag supply device set forth in claim 4, wherein the first mounting portion includes bag retaining means that is adapted to retain the packaging bags; and the bag retaining means retains a front portion of the packaging bags in an inclined posture relative to a vertical direction when in the mounting position.

8. The packaging bag supply device set forth in claim 7, wherein the bag retaining means includes a pair of pins that are adapted to be inserted into holes provided in the packaging bags; and the pair of pins is provided such that a space between the pair of pins is adjustable.

9. The packaging bag supply device set forth in claim 8, wherein the first mounting portion further includes a plurality of support members that support the packaging bags, one of the plurality of support members that is frontmost in a transport direction has the pair of pins provided therewith, and one of the plurality of support members that is rearmost in the transport direction has a control member that controls a position of the packaging bags in a direction perpendicular to the transport direction.

10. The packaging bag supply device according to claim 4, wherein the transportation means further includes a second mounting portion spaced apart from the first mounting portion by a predetermine distance such that when one of the first and second mounting portions is at the discharge position, the other of the first and second mounting portions is positioned at the mounting position.

11. The packaging bag supply device set forth in claim 10, further comprising a first bag presence sensor that is disposed at the discharge position and determines whether packaging bags are present on one of the first and second mounting portions that is at the discharge portion; and a second bag presence sensor that is disposed at the mounting position and determines whether packaging bags are present on one of the first and second mounting portions that is at the mounting position, the control means being operatively coupled to the first and second bag presence sensors and controlling the transportation means based on detection results of the first and second bag presence sensors.

12. The packaging bag supply device set forth in claim 4, wherein a transport direction length of the first mounting portion is sized to be shorter than a transport direction length of the packaging bags.

13. The packaging bag supply device set forth in claim 1, further comprising horizontal detection means that is operatively coupled to the control means and detects whether or not the uppermost surface of the uppermost packaging bag is horizontal at the discharge position.

14. The packaging bag supply device set forth in claim 13, wherein the horizontal detection means includes:

a first bag position sensor that detects a vertical position of the front portion of the uppermost packaging bag in a transportation direction of the transportation means; and a second bag position sensor that detects a vertical position of the rear portion of the uppermost packaging bag in the transportation direction.

15. A bagging device adapted to receive a plurality of small bags and bag the small bags in a large packaging bag, the bagging device comprising an introduction device that receives the plurality of small bags;

a packaging bag supply device that supplies a plurality of large packaging bags to a discharge position one by one and includes transportation means that transports the plurality of packaging bags in a stacked state from a mounting position to the discharge position, horizontal support means that supports the plurality of stacked large bags such that an uppermost surface of an uppermost packaging bag is retained in a horizontal posture at the discharge position, and control means that controls the horizontal support means such that the uppermost surface of the uppermost packaging bag is supported in the horizontal posture;

a bagging station located at a bagging position where the small bags are packaged in a packaging bag; and a bag transportation mechanism that transports a large bag discharged one by one from the packaging bag supply device at the discharge position to the bagging position of the bagging station.

16. The bagging device set forth in claim 15, wherein the horizontal support means supports a rear portion of the packaging bags at the discharge position.

17. The bagging device set forth in claim 15, wherein the horizontal support means includes a support roller.

18. The bagging device set forth in claim 15, wherein the transportation means includes a first mounting portion to which the packaging bags are adapted to be mounted at the mounting position.

19. The bagging device set forth in claim 18, wherein the first mounting portion does not interfere with the horizontal support means when the control means controls the horizontal support means to retain the uppermost surface of the uppermost packaging bag in the horizontal posture.

20. The bagging device set forth in claim 18, wherein the first mounting portion is adapted to mount the packaging bags in a substantially vertical posture at the mounting position; and the transportation means includes an endless member such that the packaging bags are transported from the mounting position to the discharge position by the endless member.

21. The bagging device set forth in claim 18, wherein the first mounting portion includes bag retaining means that is adapted to retain the packaging bags; and the bag retaining means retains a front portion of the packaging bags in an inclined posture relative to a vertical direction when in the mounting position.

22. The bagging device set forth in claim 21, wherein the bag retaining means includes a pair of pins that are adapted to be inserted into holes provided in the packaging bags; and the pair of pins is provided such that a space between the pair of pins is adjustable.

23. The bagging device set forth in claim 22, wherein the first mounting portion further includes a plurality of support members that support the packaging bags, one of the plurality of support members that is frontmost in a transport direction has the pair of pins provided therewith, and one of the plurality of support members that is rearmost in the transport direction has a control member that controls a position of the packaging bags in a direction perpendicular to the transport direction.

24. The bagging device according to claim 18, wherein the transportation means further includes a second mounting portion spaced apart from the first mounting portion by a predetermine distance such that when one of the first and second mounting portions is at the discharge position, the other of the first and second mounting portions is positioned at the mounting position.

25. The bagging device set forth in claim 24, further comprising a first bag presence sensor that is disposed at the discharge position and determines whether packaging bags are present on one of the first and second mounting portions that is at the discharge portion; and a second bag presence sensor that is disposed at the mounting position and determines whether packaging bags are present on one of the first and second mounting portions that is at the mounting position, the control means being operatively coupled to the first and second bag presence sensors and controlling the transportation means based on detection results of the first and second bag presence sensors.

26. The bagging device set forth in claim 18, wherein a transport direction length of the first mounting portion is sized to be shorter than a transport direction length of the packaging bags.

27. The bagging device set forth in claim 15, further comprising horizontal detection means that is operatively coupled to the control means and detects whether or not the uppermost surface of the uppermost packaging bag is horizontal at the discharge position.

28. The bagging device set forth in claim 27, wherein the horizontal detection means includes:

a first bag position sensor that detects a vertical position of the front portion of the uppermost packaging bag in a transportation direction of the transportation means; and a second bag position sensor that detects a vertical position of the rear portion of the uppermost packaging bag in the transportation direction.

* * * * *